US008719968B2

(12) United States Patent
DeBoer

(10) Patent No.: US 8,719,968 B2
(45) Date of Patent: May 13, 2014

(54) ADJUSTABLE FACIAL PROTECTOR

(76) Inventor: John Michael DeBoer, Spring, TX (US)

( * ) Notice: Subject to any disclaimer, the term of this patent is extended or adjusted under 35 U.S.C. 154(b) by 175 days.

(21) Appl. No.: 13/153,395

(22) Filed: Jun. 4, 2011

(65) Prior Publication Data

US 2012/0137413 A1 Jun. 7, 2012

Related U.S. Application Data

(63) Continuation-in-part of application No. 12/958,247, filed on Dec. 1, 2010.

(51) Int. Cl.
*A42B 1/08* (2006.01)

(52) U.S. Cl.
USPC ..... 2/424; 2/425

(58) Field of Classification Search
USPC ..... 2/9–10, 15, 424–426
See application file for complete search history.

(56) References Cited

U.S. PATENT DOCUMENTS

| | | | | | |
|---|---|---|---|---|---|
| 571,437 | A | * | 11/1896 | Gray | 2/9 |
| 1,696,198 | A | * | 12/1928 | Gross | 2/10 |
| 2,918,060 | A | * | 12/1959 | Lobelle | 128/201.24 |
| 2,944,263 | A | * | 7/1960 | Rayburn et al. | 2/9 |
| 3,139,624 | A | * | 7/1964 | Humphrey | 2/9 |
| 3,815,152 | A | * | 6/1974 | Bednarczuk et al. | 2/9 |
| 3,992,722 | A | * | 11/1976 | Rhee | 2/424 |
| 4,587,677 | A | * | 5/1986 | Clement | 2/424 |
| 4,885,806 | A | * | 12/1989 | Heller | 2/423 |
| 4,947,490 | A | * | 8/1990 | Hayden | 2/424 |
| 5,249,347 | A | * | 10/1993 | Martinitz | 29/460 |
| 5,384,914 | A | * | 1/1995 | Caveness et al. | 2/9 |
| 5,581,816 | A | * | 12/1996 | Davis | 2/416 |
| 5,661,849 | A | * | 9/1997 | Hicks | 2/9 |
| 5,956,777 | A | * | 9/1999 | Popovich | 2/424 |
| 5,963,990 | A | * | 10/1999 | White | 2/424 |
| 5,966,744 | A | * | 10/1999 | Smith, Jr. | 2/424 |
| 5,987,640 | A | * | 11/1999 | Ryder | 2/10 |
| 6,047,400 | A | * | 4/2000 | Spencer | 2/9 |
| 6,938,273 | B2 | * | 9/2005 | Ko | 2/10 |
| 7,540,034 | B2 | * | 6/2009 | Bologna | 2/9 |
| 2007/0151003 | A1 | * | 7/2007 | Shih | 2/424 |
| 2007/0250992 | A1 | * | 11/2007 | Brown | 2/424 |
| 2008/0209617 | A1 | * | 9/2008 | Castillo | 2/461 |
| 2010/0122402 | A1 | * | 5/2010 | Tipp | 2/422 |

* cited by examiner

*Primary Examiner* — Richale Quinn
(74) *Attorney, Agent, or Firm* — DeBoer IP, PC; John M. DeBoer

(57) ABSTRACT

A head gear assembly for protecting a user's head, the assembly having an upper head portion; a facial protector connectively attached to the upper head portion; and a movable armature for movable engagement to at least a portion of the facial protector, wherein engagement between the movable armature and the least a portion of the facial protector forms at least one gap a gap further comprising a gap size, and wherein the gap size is adjustable from a first size to a plurality of other sizes.

16 Claims, 27 Drawing Sheets

918
951
997B
996
995
950
954

1058
1013
1050
1054

1059
1013
1054
1050

1013
1050
1051

ADJUSTABLE FACIAL PROTECTOR

CROSS-REFERENCE TO RELATED APPLICATIONS

This application is a continuation in-part of United States Non-Provisional patent application Ser. No. 12/958,247, filed on Dec. 1, 2010.

BACKGROUND OF THE DISCLOSURE

1. Field of the Disclosure

Embodiments disclosed herein relate generally to protective head gear. Other embodiments disclosed herein relate to a protective headgear assembly for sports or activities generally associated with eye and/or facial protection as part of the protective head gear. Specific embodiments disclosed herein may relate to protective sports equipment, and particularly to facial protector components used with a helmets.

For convenience and clarity, reference may generally be made to a hockey helmet throughout the disclosure, but it should be understood that the disclosure is not limited in any way by the description of embodiments as they may appear relevant to a hockey helmet. Further, "hockey" in itself is also not meant to be limited, and may include any form of the game, such as ice hockey, field hockey, street hockey, in-line hockey, roller hockey, floor hockey, etc.

2. Background

The evolution of head and facial protection design has long been synonymous with those that require protection by participating in an active lifestyle, especially that of industry and sport. Over time, technology has provided protection ranging from simplistic head protection in the form of helmets, to modern head protection that often demands a combination of complex designs with different concepts developed for any number of reasons, including the general concept of safety.

Helmets, rigid shells, or other forms protective head gear, are generally designed with a primary purpose to protect a user's head from injury in the event that a force, projectile, or other foreign object becomes a directed thereat. For example, a principal objective of helmets for use in an activity or sport may be user (e.g., wearer, player, etc.) safety. Government and/or other standards may exist that govern the performance of helmets intended for certain activities when subjected to any number of conditions.

However, a helmet by itself is oftentimes insufficient for full head protection because it may not protect a user's eyes, ears, mouth or other bodily areas. In the sport of hockey, for example, these areas are prone to contact with dangerous and/or fast-moving objects such as a stick or a puck, or possibly another player's fingers (or any other kind of projectile or foreign object), as well as other elements such as rain, snow, perspiration/sweat, etc.

With respect to various sports or activities, there are numerous conventional features directed to head gear safety, and particularly protection of a facial region, but often to the detriment of user performance. For example, one option may provide full facial protection by mounting a clear impact-resistant full visor or shield to the head gear; however, this option is limited by poor ventilation. Another option is a clear "half" visor or shield attached to the head gear, which is often done to provide the capability of the head gear to have better ventilation to prevent fogging. However, the facial protection is limited to only half the face.

Another option includes the use of a "full" cage-type shield, which typically provides a greater amount of facial protection in combination with adequate ventilation in order to provide aid to a user's vision and performance, while still promoting safety and protection. There are different cages for different aspects of a sport, such as a position player mask versus a goalie mask. Similarly, in baseball (or softball) there can be a position player mask versus a catcher mask.

A full cage-type or wire mesh face mask may provide a better option to prevent the problem of accumulating moisture or perspiration that occurs on a visor or shield; however, these masks still lack the capability to provide a fully adequate range of vision for the user. In particular, cages and masks adapted to head gear are typically configured with some form of a rigid/static horizontal and vertical bar connection that forms a kind of grid across the face, as shown in FIG. 1.

Referring to FIGS. 1A and 1B, a full cage facial protector mounted to a head gear, is shown. FIGS. 1A and 1B together show a head gear assembly 1 that includes a head gear 10 with an attached cage 12. The cage 12 is formed by any means known to a person having ordinary skill in the art, such as by crossing and securing substantially vertical members 16 with substantially horizontal members 18. Typically, the cage 12 is attached to the head gear 10 in order to protect a face/head 14 and/or a facial region 20 from various elements, such as flying objects or the like.

As illustrated, the cage 12 has a plurality of gaps 2 disposed within the cage, and the size of any of the gaps 2 may be determined by, for example, a gap size 3. Typically, the gap 2 and the gap size 3 are static in nature (i.e., the dimensions do not change). When donned by a user, the static nature of members 16 and 18 become a hindrance to the performance of the head gear assembly 1 because the user's range of vision is impaired. The range of vision may include straight ahead vision, side-to-side vision, peripheral vision, as well as a line of sight vision, and is not meant to be limited in any way. As shown in FIG. 1, a user's line of sight P1 is directly impaired by horizontal member 16*a*.

Though a user may initially don the head gear assembly 1 without an initial range of vision impairment, any movement that occurs as a result of partaking in an activity typically subjects the user's line of sight to the members 16 and/or 18. Thus, the cage 12 interferes with the user's range of vision, even when the cage 12 is properly positioned, because the cage 12 moves relative to the user's face during use.

FIGS. 2A and 2B show a helmet 1 having some vertical bars removed from a protective mask, as well as making the mask itself adjustable to change a line of sight angle from x-x' to y-y', which functions by adjusting the mask to vertically move (i.e., pivot) the line of sight P1 of a user.

However, while the line of sight P1 and/or direction of vision might change, the size of the gap does not. In other words, gap size 58 remains static at all times; instead of a dynamic gap size, the static gap size 58 is shifted downward by a distance 72, thereby changing the planar line of sight P1 to planar line of sight P2. Unfortunately, this configuration is still inadequate because the gap in the mask still subjects a user to the dangers previously mentioned. For example, FIGS. 2C and 2D illustrate an object O penetrating the mask both before and after the mask has been adjusted.

As may be understood from the description above, protective facial gear configured in this manner provide a static gap size and no ability to improve hindered line of sight. While the gap itself might be moveable in the sense that that mask may be moved, this aspect does not account for the numerous differences of potential users that might require an ability to slightly change this gap size or to move the gap to a position where the impairment of vision is reduced accordingly because one user will naturally not have the same exact line-of-sight requirement as another. For example, during activities a user's head gear is often subjected to frequent head movements, characterized by repeated lowering and raising, or side-to-side turning of the head. While such movements are natural and necessary, the static gap size of the grid will generally interfere with or impair the user's vision at any given time.

A user's line-of-sight requirement can change over time, such as a span of time where a child grows from one size to another. Variances in users (e.g., adult, young adult, child, etc.), user characteristics (e.g., big head, small head, etc.), and user requirements (e.g., the activity the head gear is used for) create a need for facial protection that provides a dynamic gap size that may be adjustable between a range of gap sizes.

What is needed is a head gear with a facial protector that may provide a dynamic gap size. There is also a need for facial protection with a dynamic gap size, where the adjustment of the gap size does not detrimentally affect the user's line of sight. What is further needed is facial protector with a vision gap, where the size of the gap can be adjusted to enhance the performance of the head gear. It is desirable to provide a head gear that provides an appropriate balance between user safety and user performance.

What is further needed is a cheap and inexpensive way to readily and easily adjust facial protection to improve head gear performance and reduce or eliminate vision impairment. There is also a need for facial gear components configured to provide an adjustable gap size without undermining the integrity of the head gear.

SUMMARY

Embodiments disclosed herein may provide for a head gear assembly that may include a rigid shell, and a facial protector may be connectively attached to the rigid shell. The facial protector may includes a gap and a gap size, wherein the gap size may be adjustable between a plurality of gap sizes.

Other embodiments disclosed herein may provide for a head gear assembly that includes a rigid shell, as well as a facial protector connectively attached to the rigid shell. The facial protector may thus include a gap and a gap size, wherein the gap size may be adjustable from a first size to a plurality of other sizes, and a plane defined by a line of sight, wherein the line of sight may remain unchanged when the gap size is adjusted.

In other aspects, embodiments disclosed herein may provide for a method of adjusting an ocular gap size that may include donning a head gear assembly that further includes a rigid shell, and a facial protector connectively attached to the rigid shell further. The facial protector may include an ocular gap having a gap size, such that the gap size may be adjustable between a range of gap sizes. There may be a plane defined by user's line of sight, wherein the line of sight may remain unchanged when the gap size is adjusted, and adjusting the gap size to optimize the head gear performance.

A method of manufacturing a head gear assembly that may include forming a rigid shell, and producing a facial protector configured to movingly attach to the rigid shell. The facial protector further includes a gap and a gap size, wherein the gap size is adjustable between a range of gap sizes.

In still other aspects, embodiments disclosed herein may provide for a method of adjusting a head gear assembly. The method may include the step of using a head gear assembly that may include a facial protector, and may also include a movable armature configured for movable engagement with at least a portion of the facial protector. Engagement between the movable armature and the least a portion of the facial protector may form at least one gap a gap with a gap size, whereby the gap size may be adjustable from a first size to a plurality of other sizes. Other steps of the method may include adjusting the first gap size to one of a plurality of other gap sizes.

Embodiments disclosed herein may provide for a movable armature for a head gear assembly facial protector. The movable armature may include at least one horizontal armature member, and may also include at least one vertical armature member fixedly connected to the at least one horizontal member. The movable armature may be configured for engagement to at least a portion of the head gear assembly facial protector.

In yet other aspects, embodiments disclosed herein may provide for a head gear assembly for protecting a user's head. The assembly may include an upper head portion, and may also include a facial protector connectively attached to the upper head portion. The assembly may further include a movable armature for movable engagement to at least a portion of the facial protector, such that engagement between the movable armature and the least a portion of the facial protector may form at least one gap a gap with a gap size. The gap size may be readily and easily adjustable from a first size to a plurality of other sizes.

Other aspects and advantages of the disclosure will be apparent from the following description and the appended claims.

BRIEF DESCRIPTION OF DRAWINGS

A full understanding of embodiments disclosed herein is obtained from the detailed description of the disclosure presented herein below, and the accompanying drawings, which are given by way of illustration only and are not intended to be limitative of the present embodiments, and wherein.

DETAILED DESCRIPTION

Figure 1A:
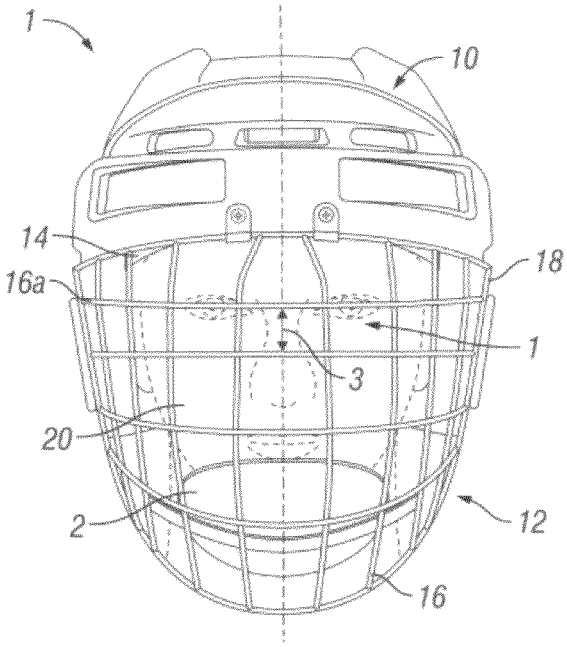
FIG. 1A (Prior Art)
FIGS. 1A and 1B show a full cage facial protector mounted to a head gear.
Figure 1B:
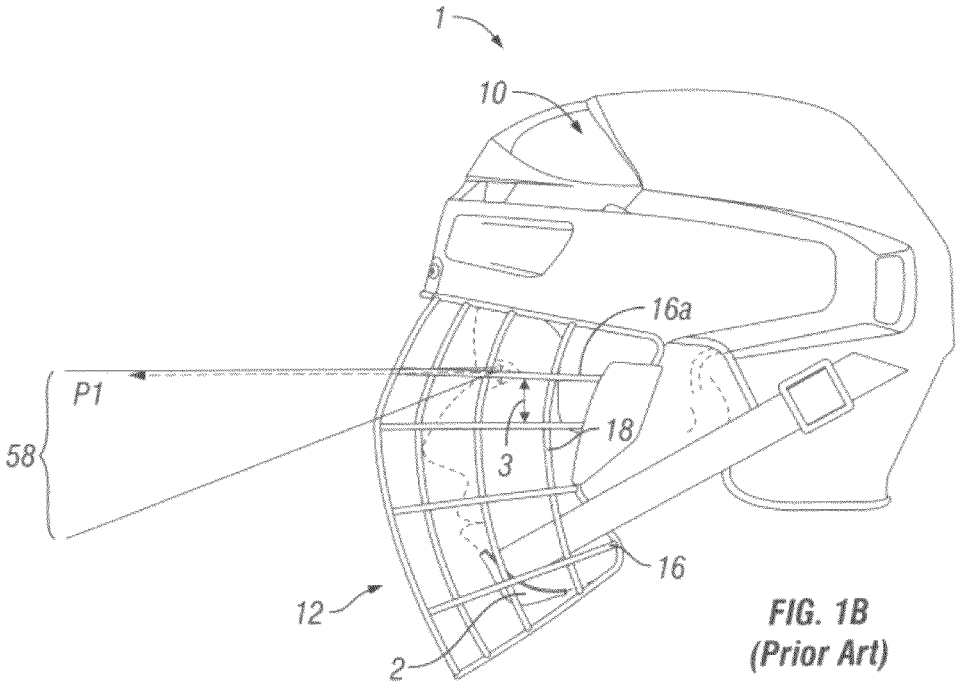
FIG. 1B (Prior Art)
Figure 2A:
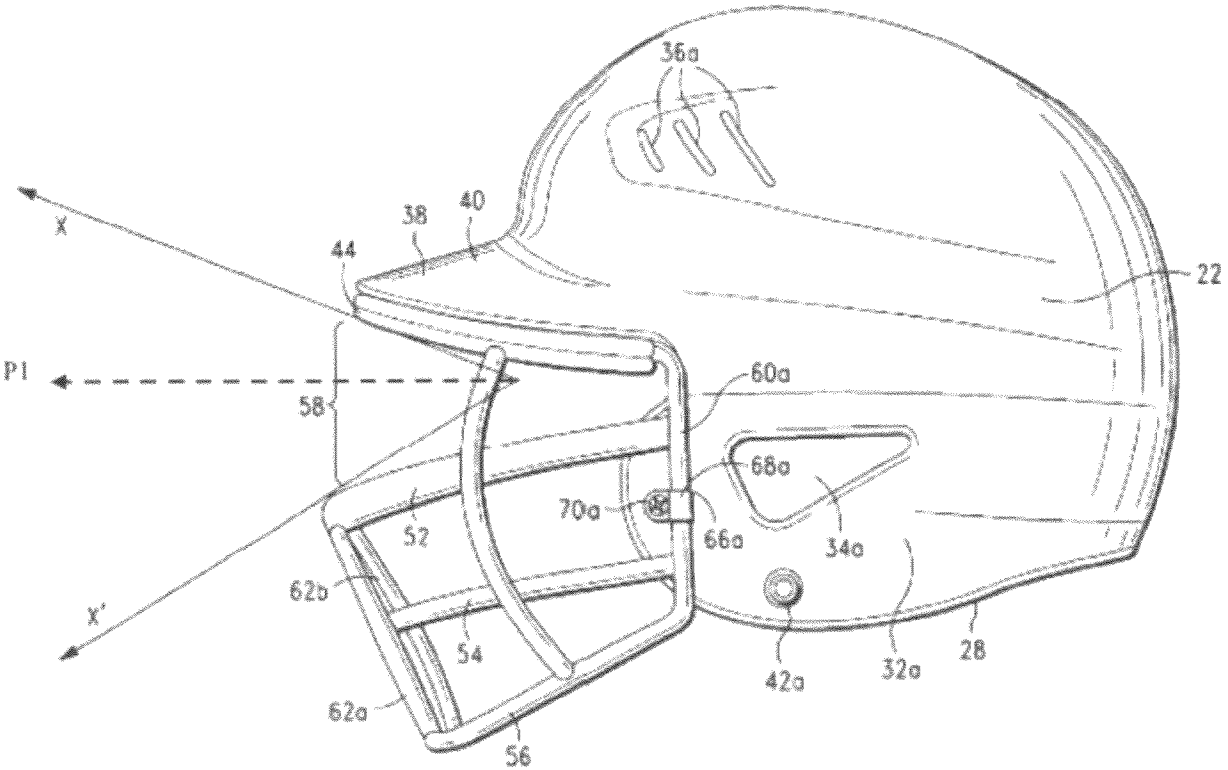
FIG. 2A (Prior Art)
FIGS. 2A, 2B, 2C, and 2D show deficiencies of a facial protector with a static gap size.
Figure 2B:
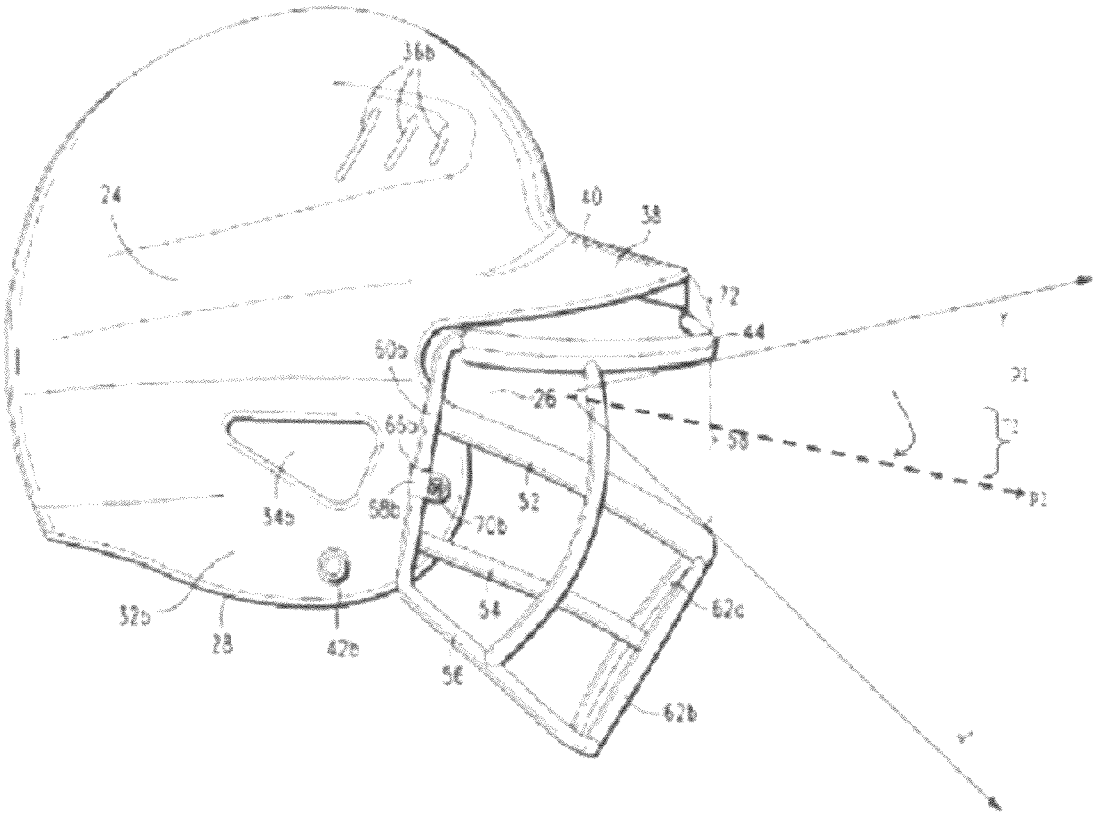
FIG. 2B (Prior Art)
Figure 2C:
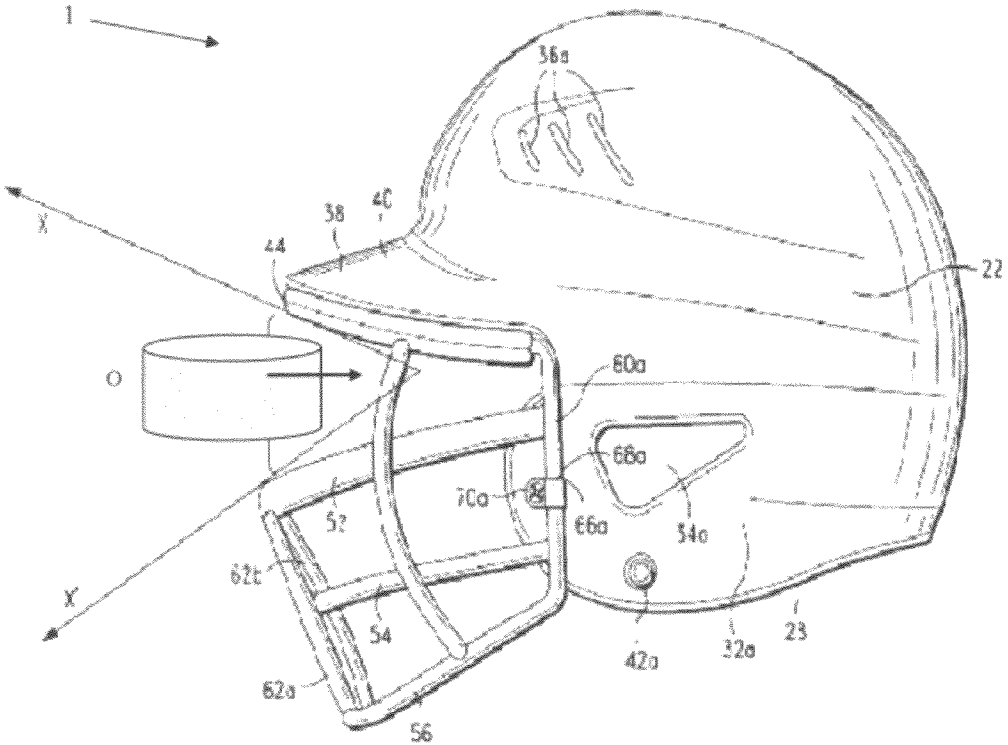
FIG. 2C (Prior Art)
Figure 2D:
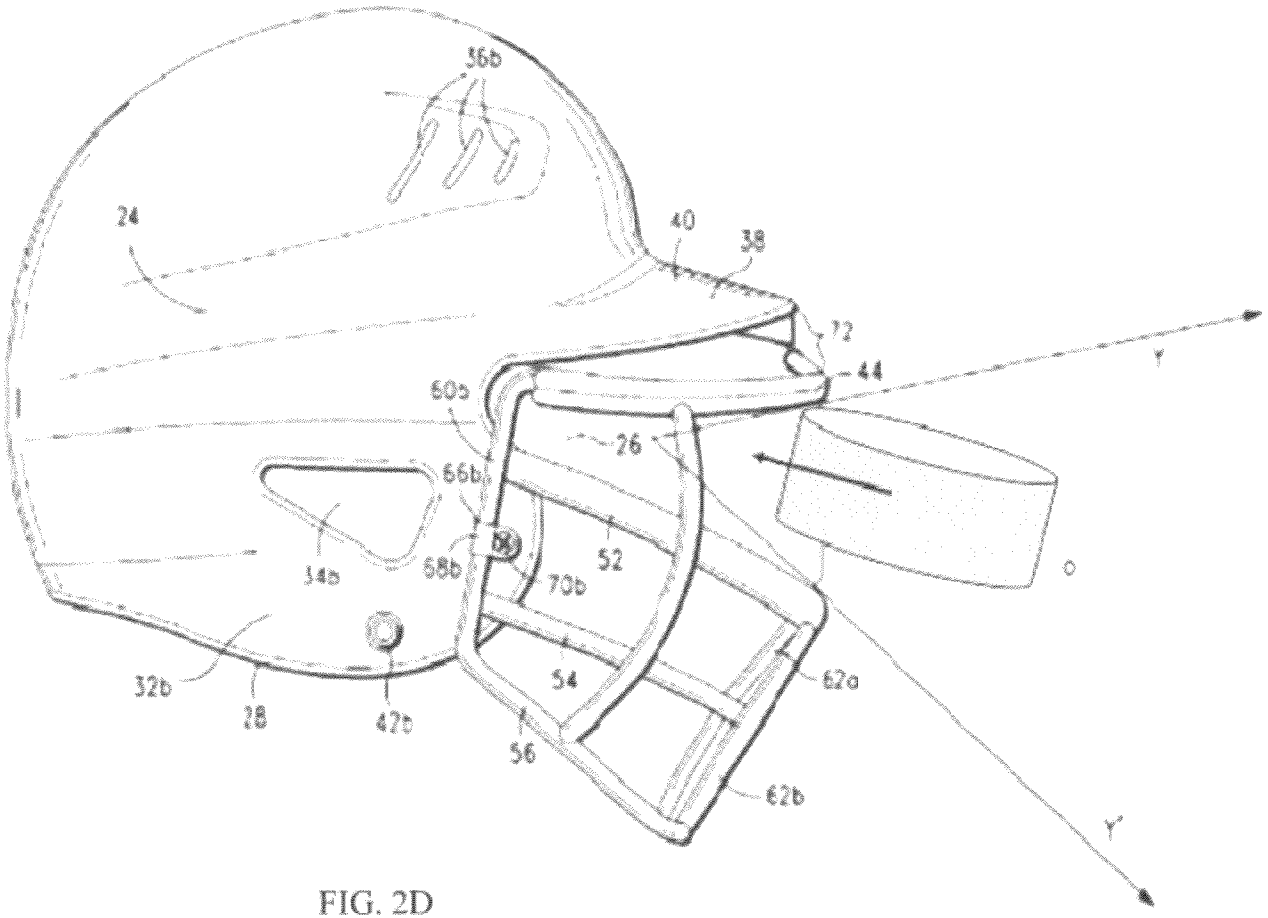
FIG. 2D (Prior Art)

While the disclosure may be described hereinbelow with reference to head gear used in a sport, such as hockey, it should be understood that the disclosure is not limited to the specific configurations shown by the embodiments. Rather, one skilled in the art will appreciate that a variety of configurations may be implemented in accordance with embodiments herein.

Specific embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the disclosure. However, it will be apparent to one of ordinary skill in the art that the embodiments disclosed herein may be practiced without these specific details. In other instances, well-known features have not been described in detail to avoid unnecessarily complicating the description.

In addition, directional terms, such as "above," "below," "upper," "lower," "front," "back," etc., are used for convenience in referring to the accompanying drawings. As such, these indicator words refer to general direction and/or orientation, and are only intended for illustrative purposes only, and the terms are not meant to limit the disclosure.

Figure 3A:
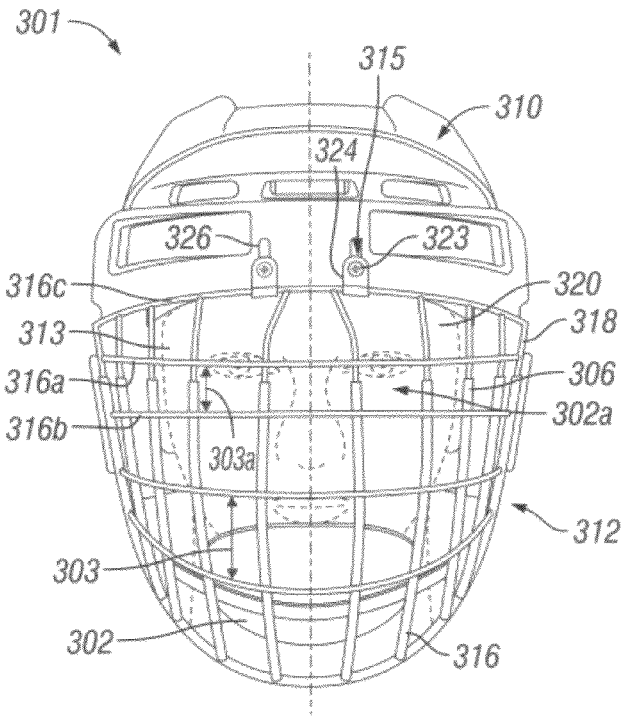
FIGS. 3A and 3B show a front view and a side view of a head gear assembly, in accordance with embodiments of the present disclosure.
Figure 3B:
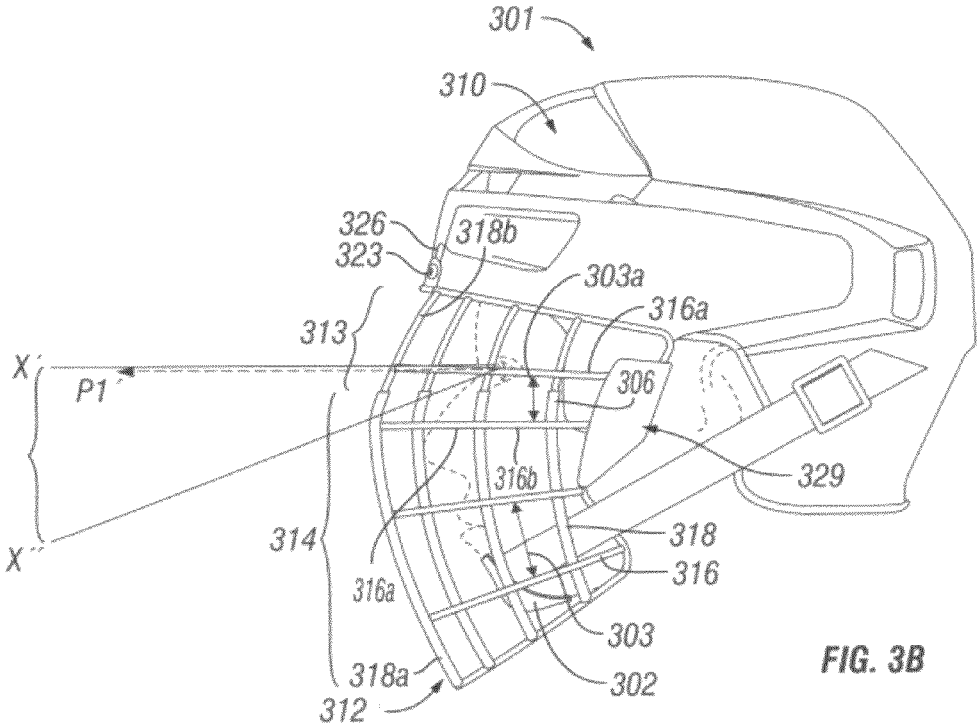

Referring now to FIGS. 3A and 3B, a front view and a side view of a head gear assembly according to embodiments of the present disclosure, is shown. As illustrated by FIGS. 3A and 3B together, the head gear assembly 301 may include a rigid shell or upper head portion 310 and a facial protector 312 coupled to the rigid shell 310. The coupling of the facial protector 312 to the rigid shell 310 may be by any means known in the art, such as rivets, straps, snaps, pivoting devices, etc. Any of the coupling devices may be configured for adjustment, as will be illustrated by examples described herein.

The facial protector 312 may include a plurality of generally horizontal members 316 crossed with and/or secured to a plurality of generally vertical members 318 as would be known to a person of ordinary skill in the art. For example, the horizontal members 316 and vertical members 318 may be welded together at various intersecting/crossing points 307, such that a "grid shaped" facial protector 312 may be formed. In some embodiments, the facial protector 312 may include a plurality of "gaps" 302 formed between the elements 316 and/or 318. In other embodiments, at least one of the gaps 302 may include a gap size 303. The gap size 303 may be determined by, for example, a height, a width, a diagonal or any other dimension of gap 302. The height (e.g., the gap size 303*a*) of the gap 302, for example, may be determined by the distance between a first horizontal member 316*b* and a second horizontal member 316*a* directly above (or directly below) the first horizontal member 316*b*.

In one embodiment, the gap size 303 may be less than two inches; in still other embodiments, the size of the gap may be greater than two inches. However, the gap size is not meant to be limited and may vary in size depending on the particular application the head gear assembly 301 is being used for. The gap size 303 may also vary depending upon an amount of adjustment made to the gap size 303. The gap size could also be determined by the distance between other members, such as between two vertical members 318.

The gaps 302*a* in the facial protector 312 allow a user (i.e., wearer, donner, etc.) to have a line-of-sight P1' through the facial protector 301. The line of sight P1' may be determined by an angle of vision X'X" limited by the space between horizontal and/or vertical members 316 and 318. In one embodiment, the gap 302*a* may be an ocular gap, which may be one or more of the gaps formed proximate to the ocular region of a user. In another embodiment, the gap 302*a* (or any of the gaps 302) may be configured with an adjustable gap size 303*a*. In one aspect, the gap size 303*a* may be adjustable between a range of gap sizes.

In various embodiments, the gap size 303*a* may be adjusted to suit a user's needs. Thus, the user may initially have a gap size such that a horizontal or vertical member impairs the range of vision. Accordingly, the user may adjust the gap vision in a limited amount to remove the impairment, while still maintaining a significant amount of safety. Therefore, the user may improve the operable performance of the head gear assembly without reducing the safety performance.

Accordingly, the head gear assembly 301 may be used in sports or activities that use a small gap size; however, with the adjustment of the gap size 303*a*, the head gear assembly may be configured with an increased gap size. The head gear assembly 301 may be used in sports or activities that do not require a small gap size. For example, the head gear assembly 301 may be used in the sport of hockey as a hockey helmet, but the head gear assembly may also be used for industrial purposes. For example, the head gear assembly 301 may be used by a construction worker or a welder.

Figure 4A:
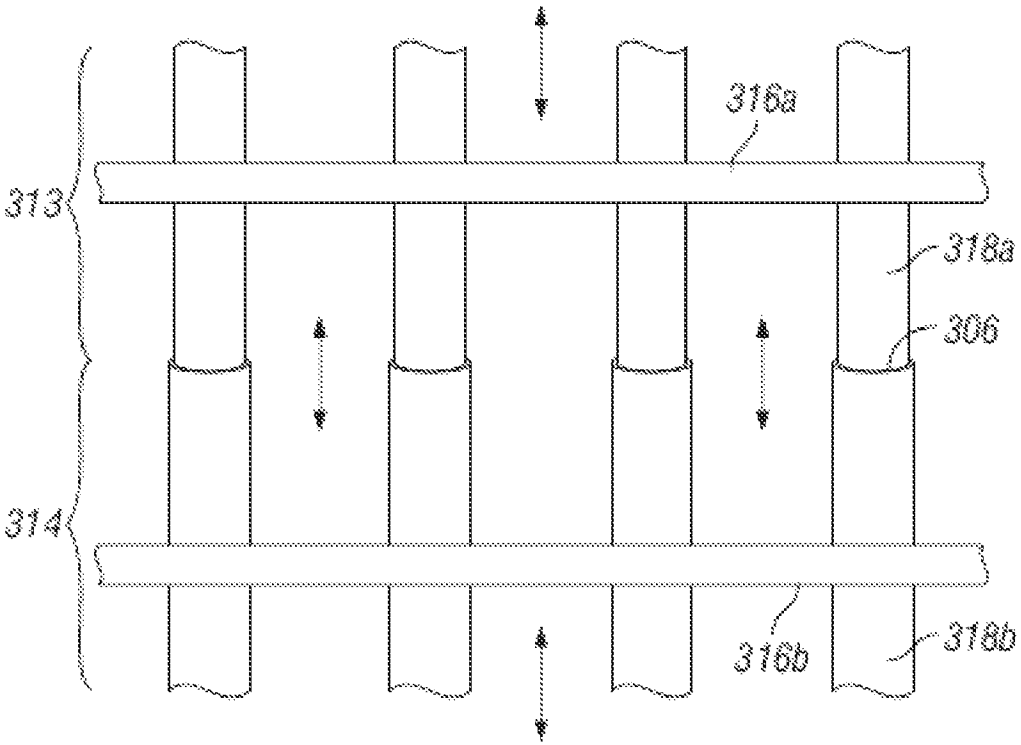
FIG. 4A shows various members of a facial protector telescopingly engaged with each other, in accordance with embodiments of the present disclosure.

Referring briefly to FIG. 4A, a snapshot of members telescopingly and/or slidingly engaged with each other according to embodiments of the present disclosure, is shown. FIG. 4A shows upper portion 313 engaged with the lower portion 314. In one embodiment, the upper portion 313 and the lower portion 314 are telescopingly engaged; however, the engagement between any portions of the head gear assembly 301 is not meant to be limited and may occur in other ways without leaving the scope of the disclosure.

The horizontal members 316 and the vertical members 318 may be any kind of material used for a facial protector. For example, the members 316 and 318 may be any kind of weldable carbon steel, or some other durable impact-resistant type material. In an exemplary embodiment, facial protector 312 may have an upper portion 313 telescopingly engaged with a lower portion 314, such that the upper portion 313 and the lower portion 314 may telescopingly (e.g., slidingly, movingly, etc.) move apart from each other. Each of generally vertical elements 318*a* in the upper portion 313 may be telescopingly engaged with corresponding vertical elements 318*b* in lower portion 314 so that as the gap size 303 may be adjusted as the upper portion 313 moves freely from the lower portion 314.

FIG. 4A illustrates a telescopingly engaged embodiment, such that the upper portion 313 and the lower portion 314 are may move freely from each other. In this manner, vertical members 318*a* may move inward and outward (e.g., up and down) from vertical members 318*b* at joint 306. Accordingly, a portion of the vertical members 318*a* may be configured with an outer diameter, D1, slightly smaller than the inner diameter, D2, of the vertical members 318*b*. It is to be understood that the vertical members 318*a* and 318*b* could be oppositely configured, such that the vertical members 318*b* could move inward and outward from the vertical members 318*a*. Additionally, the horizontal members 316, although not shown here, could be configured comparably, such that some horizontal members may move inwardly and outwardly from other horizontal members.

Figure 4B:
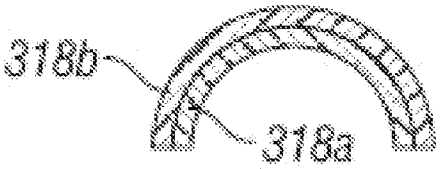
FIGS. 4B, 4C, and 4D show various lateral cross-sectional views of different embodiments of members of a facial protector engaged with each other, in accordance with embodiments of the present disclosure.
Figure 4C:
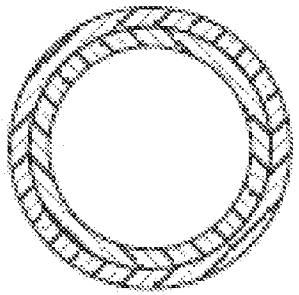
Figure 4D:
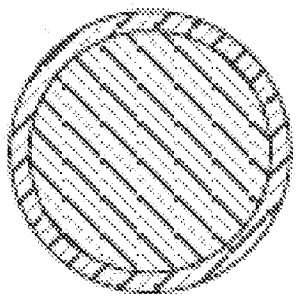

FIGS. 4B-4D illustrate the head gear assembly 301 may include any number of members configured in numerous fashions. For example, it is not necessary that any of the vertical members 318 and/or horizontal members 316 be tubular in nature; instead, they may be generally flat or semi-round shaped. The members may be configured as such that some of the members may be telescopingly, slidingly, etc. engaged with one another. FIGS. 4B-4D particularly illustrate that any of the tubular shaped members need not be hollow; instead, any of the members of the head gear assembly may also be, for example, tubular, non-tubular, solid, or combinations thereof.

Referring again to FIGS. 3A and 3B, the facial protector 312 may be adjustingly mounted to the rigid shell 310 by at least one clip and slot bracket assembly 315, which may operate as an adjustment mechanism. The assembly 315 may include clips 324, which may be configured to couple with one of the horizontal members 316*c*. The at least one clip 324 may be connectively attached to a corresponding mating connection 326 disposed in the rigid shell 310. In one embodiment, the at least one clip 324 may be secured to the rigid shell 310 by fasteners 323.

There may also be at least one adjustingly mounted bracket assembly 329 that may be mounted on the helmet by fasteners (not shown) or the like. The mounted bracket assembly 329 may have a similar configuration as the slot bracket assembly 315. In addition, the mounted bracket assembly 329 may act as a mechanical stop for the facial protector 312. In this manner, the facial protector 312 may be properly positioned over a user's face.

The slot bracket assembly 315 may cooperate with the mounted bracket assemblies, such that once the assemblies 315 and/or 329 are adjusted (e.g., repositioned, etc.), the upper portion 313 may telescopingly move away (or toward) the lower portion 314. As such, the assembly 314 and/or 329 may operate as an adjustment mechanism, whereby the gap size may be changed as a result of operation thereof. As illustrated, the facial protector 312 may have an adjusted gap size 303*b*. Notably, the angle of line of sight P1' has also not changed. This adjustment ability gives a user the ability to dynamically alter the gap 303*b*, greatly enhancing the flexibility of the head gear assembly 301.

Figure 5A:
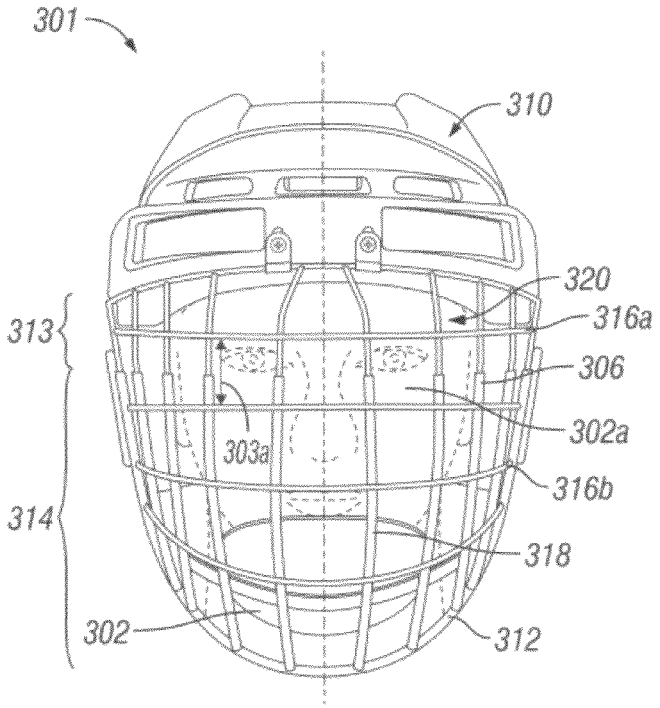
FIGS. 5A, 5B, 5C, and 5D show a front view and a side view of an adjusted facial protector, in accordance with embodiments of the present disclosure.
Figure 5B:
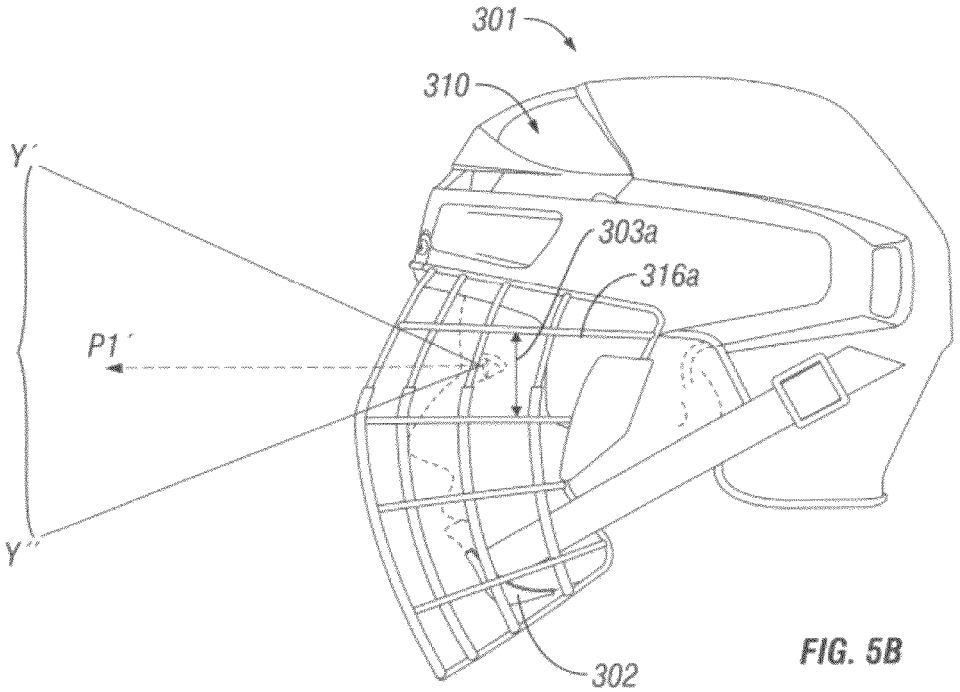
Figure 5C:
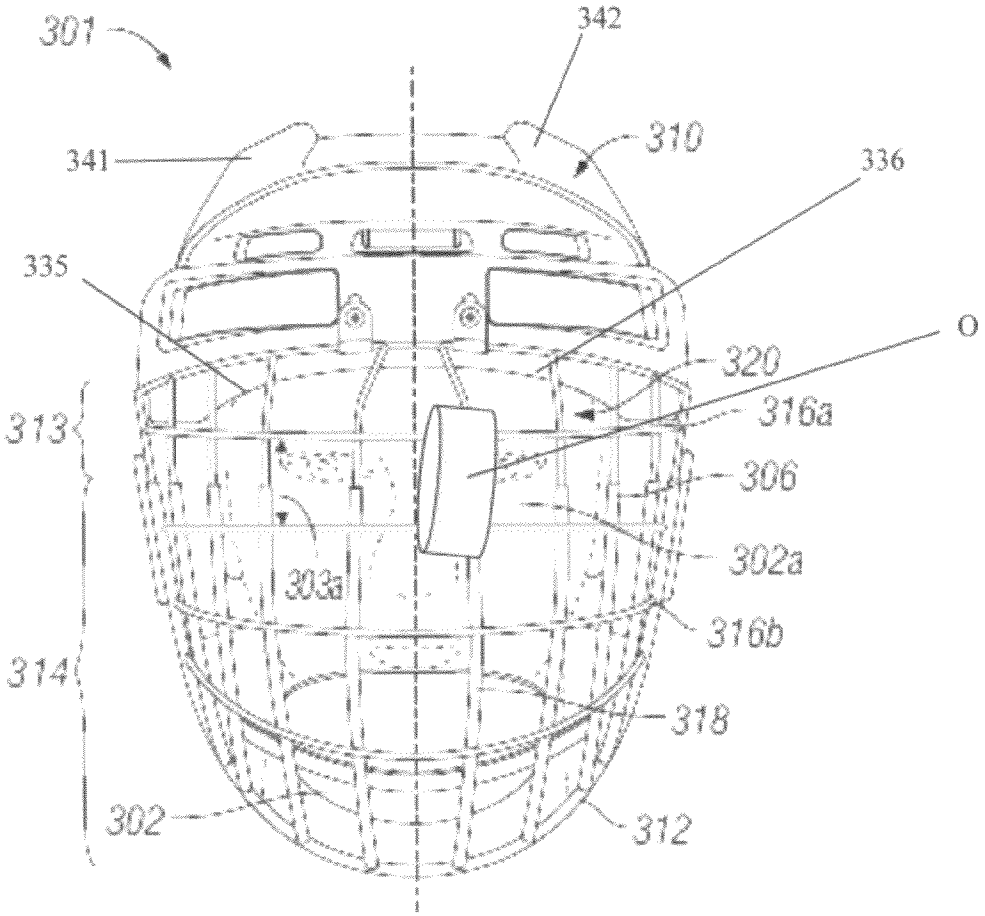
Figure 5D:
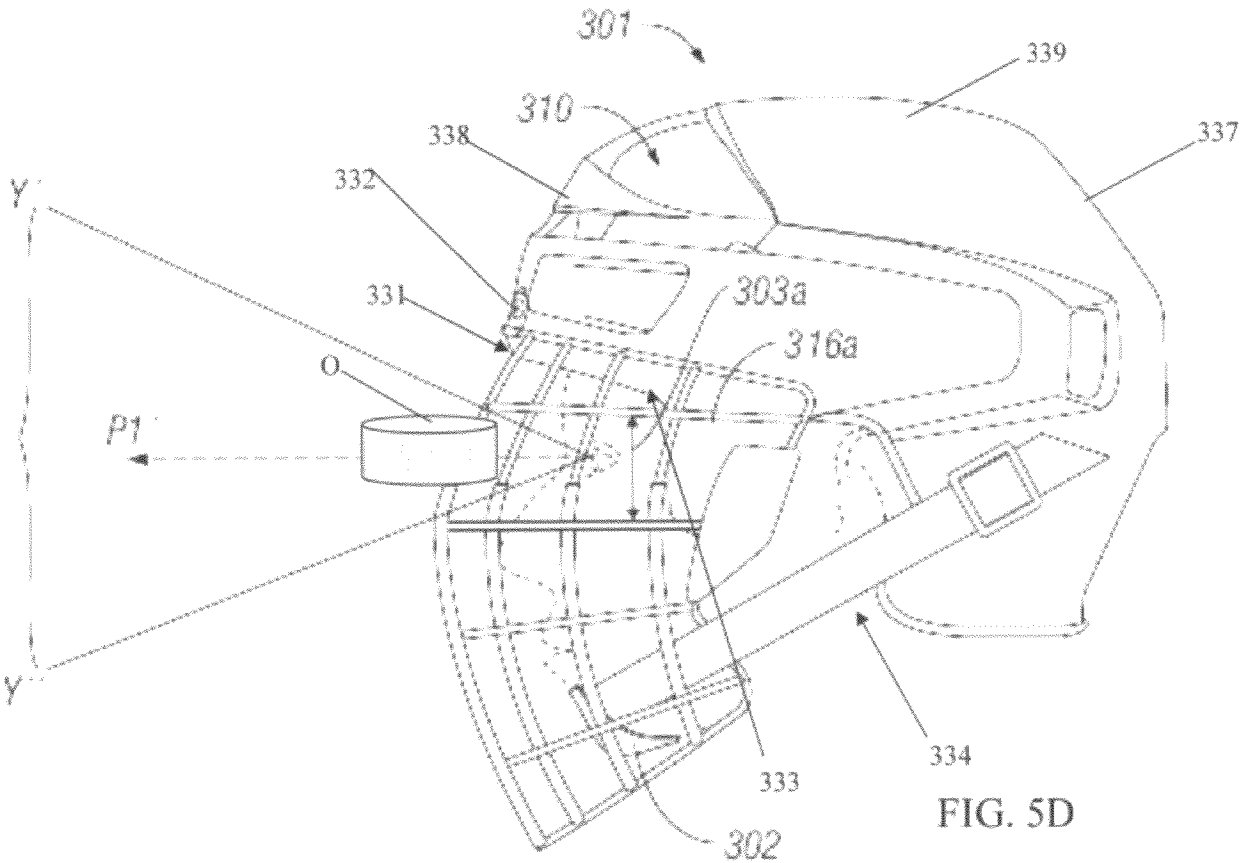

Referring to FIGS. 5A, 5B, 5C, and 5D, multiple views of a head gear assembly 301 according to embodiments of the present disclosure, is shown. As illustrated, the adjusted gap size 303*b* may be further defined by a plane, P1', which may define a line-of-sight. This plane P1' may remain unchanged before, during, and after the gap size 303*a* and/or 303*b* is adjusted. Analogously, the range of vision illustrated by previously by angle X'X" is now changed to angle Y'Y", such that the line-of-sight remains on plane P1' but is no longer hindered by a horizontal member 316*a*. Moreover, because viewing angle Y'Y" is now greater than X'X", user performance may be increased; however, safety performance is unchanged by the protection still provided against object O, as shown in FIGS. 5C and 5D.

Other aspects of the head gear assembly 301 may include an inner portion 331 that, upon donning, may contact a users head. The inner portion 331 may include an inner front side 332, and inner middle 333, and an inner rear side 334. In addition, inner portion 331 may have an inner left side 335 and an inner right side 336. The inner portion 331 may be configured to have a shock absorbing material (not shown) disposed in such a manner that a user's head is further protected from impact forces and the like.

The head gear assembly 301 may also have an outer portion 337 that, upon donning, may be exposed externally/outwardly from the user's head. The outer portion 337 may have an outer front side 338, and outer middle 339, and an outer rear side 340. In addition, outer portion 337 may have an outer left side 341 and an outer right side 342. In an embodiment, the inner portion 331 and the outer portion 337 may be configured to form an opening (not shown) that may be restricted when the facial protector 312 is operatively connected attached to the rigid shell 310.

Figure 6A:
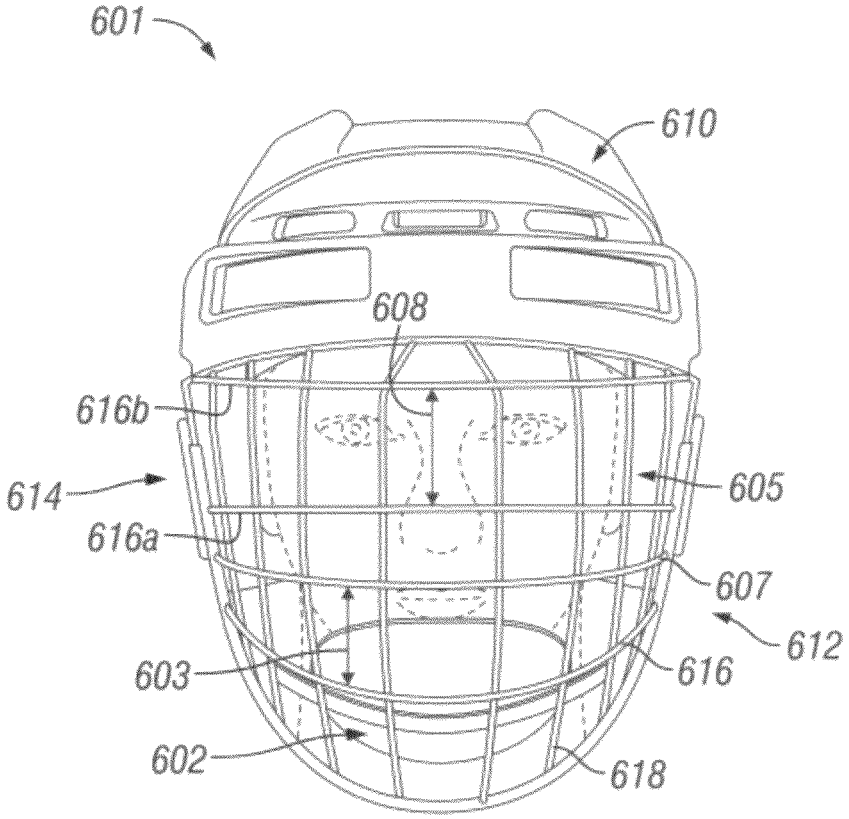
FIGS. 6A and 6B show views a head gear assembly configured with a facial protector, in accordance with embodiments of the present disclosure.
Figure 6B:
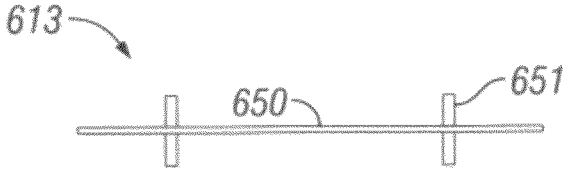

Referring to FIGS. 6A and 6B, a head gear assembly 601 configured with a facial protector 612 according to embodiments of the present disclosure, is shown. Like the head gear assembly(s) previously described, the head gear assembly 601 may be configured or otherwise constructed with a number of interconnected components and subcomponents like any of the previously discussed.

Any of the components or subcomponents may be constructed of materials, such as, steel, aluminum, rubbers, composite plastics, wood, or combinations thereof. As illustrated by FIGS. 6A and 6B together, the head gear assembly 601 may include an upper head portion 610 and a facial protector 612 configured for coupling to the upper head portion 610. The coupling of the facial protector 612 to the upper head portion 610 may be by any means known in the art, such as rivets, straps, snaps, pivoting devices, etc. Any of the coupling devices may be configured for adjustment, as previously described.

The facial protector 612 may include a plurality of generally horizontal members 616 crossed with and/or secured to a plurality of generally vertical members 618. For example, the horizontal members 616 and vertical members 618 may be welded together at various intersecting/crossing points 607, such that a generally "grid shaped" facial protector 612 may be formed. In some embodiments, the facial protector 612 may include a plurality of "gaps" 602 formed between the elements 616 and/or 618. As shown, there may be additional gaps 605 that have different shapes or size as compared to the gaps 602.

Any of the gaps 602, 605 may include a gap size 603, 608 respectively. The gap size(s) may be determined by, for example, a height, a width, a diagonal or any other dimension of gaps 602, 605. The height (e.g., the gap size 603 and/or 608) of the gaps, for example, may be determined by the distance between a first horizontal member 616*b* and a second horizontal member 616*a* directly above (or directly below) the first horizontal member 616*b*.

In an embodiment, the head gear assembly 601 may include a facial protector 612 configured with a movable member associated therewith. The movable member may be configured to move from a first position to a second position. In other embodiments, the movable member may be configured to move from a first position to a plurality of other positions. As an example, the movable member may be slidably engaged with the facial protector 612. In other embodiments, the movable member may be a horizontally oriented movable member 650 that may be engaged to, such as magnetically attracted to, and/or slidably coupled with, at least a portion 614 of the facial protector 612. For example, vertical members 651 may be magnetically attracted to corresponding portions of the facial protector 612.

Figure 6C:
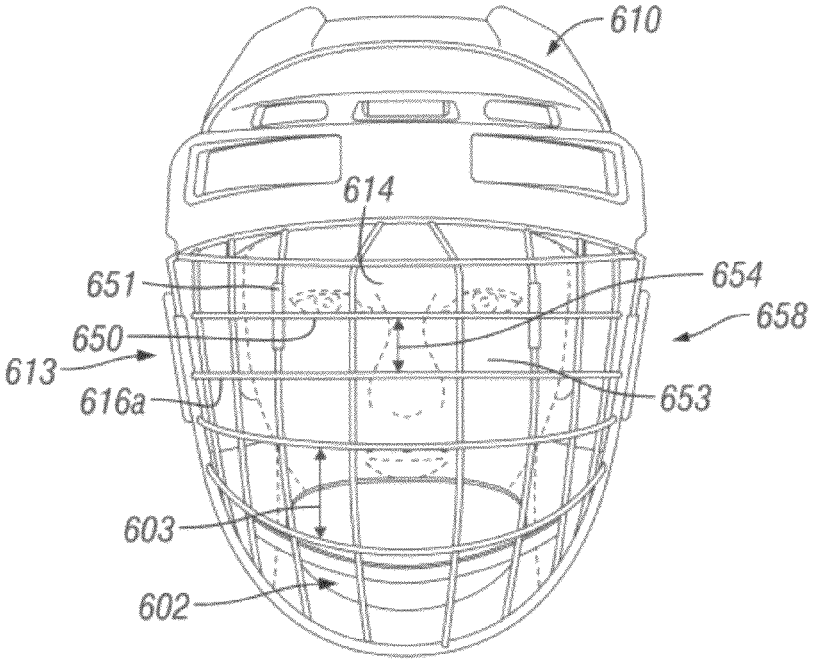
FIGS. 6C and 6D show various perspective views of a movable armature engaged with a facial protector, the movable member in a first position, and moved to a second position, respectively, in accordance with embodiments of the present disclosure.
Figure 6D:
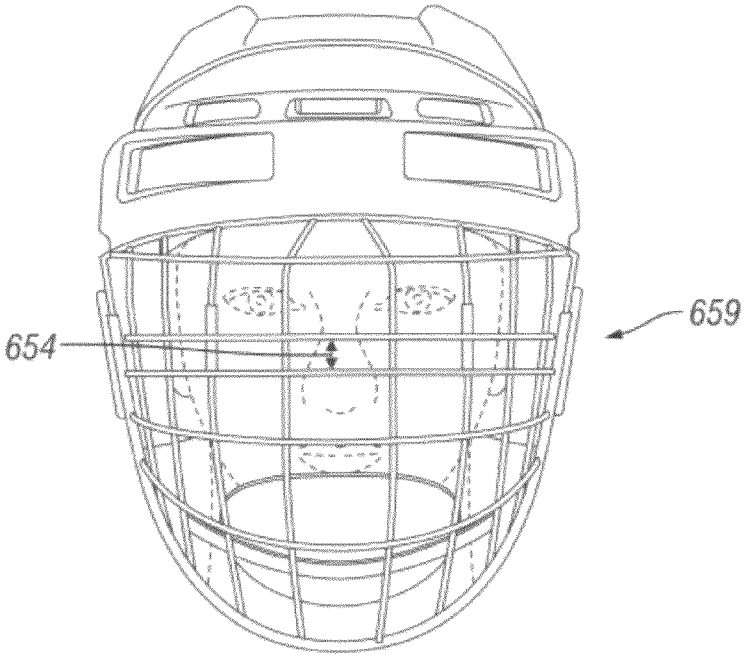

Referring now to FIGS. 6C and 6D, a perspective view of a movable armature 613 engaged with a facial protector 612, the movable member in a first position, and moved to a second position, respectively, according to embodiments disclosed herein, are shown. FIG. 6C shows the head gear assembly 601 may include the use of a movable armature 613, which may be readily coupled to the facial protector 612. The armature 613 may include at least one armature horizontal member 650. There may be at least one armature vertical member 651 connected to the at least one horizontal member 651. In an embodiment, the connection between the horizontal member 650 and the vertical member 651 may be a fixed connection, such as by welding and so forth.

The movable armature 613 may be configured for detachable connection (or other form of engagement) to at least a portion or region 614 of the facial protector 612, like the aforementioned magnetic connection. However, the movable armature 613 may be formed or otherwise constructed as slidably and/or telescopingly engaged with the facial protector 612. For example, at least one armature vertical member 651 may be formed in telescoping engagement with a corresponding vertical member 618.

The engagement between the armature 613 and the facial protector 612 may form at least one gap 653 with the gap size 654. Like other gaps 602, 605 (FIG. 6A), the gap size 654 of the at least one gap 653 may be adjustable between a plurality of gap sizes. For example, the movable armature 613 may be moved from a first position (658, FIG. 6C) to a second position (659, FIG. 6D), whereby the gap size 654 of gap 653 has changed accordingly.

Figure 6E:
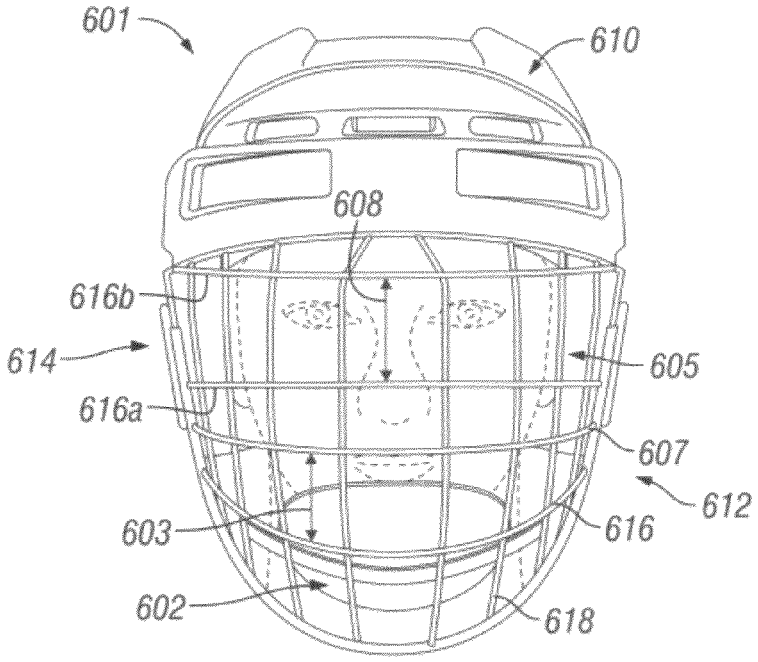
FIGS. 6E, 6F, and 6G show multiple views of a movable armature configured with multiple vertical armature members engaged with a facial protector, in accordance with embodiments of the present disclosure.
Figure 6F:
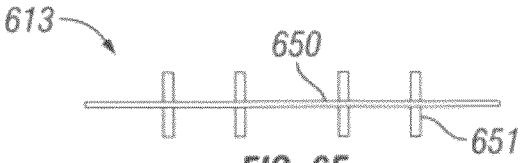
Figure 6G:
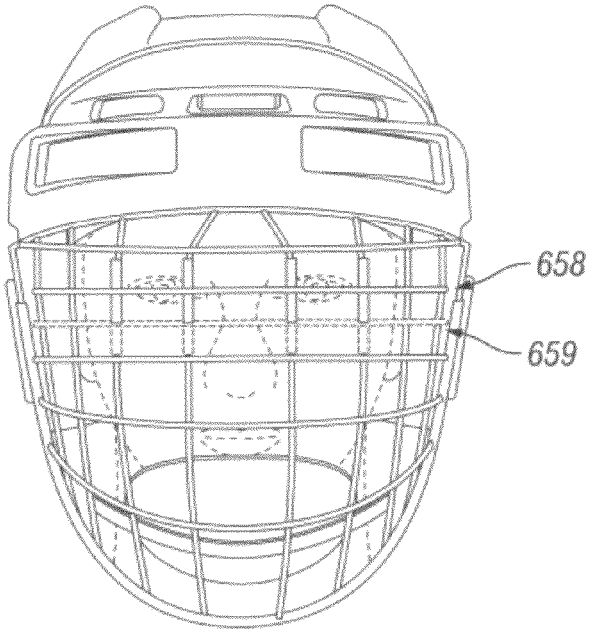

Referring briefly to FIGS. 6E, 6F, and 6G, a movable armature 613 configured with multiple vertical armature members engaged with a facial protector 612 according to embodiments disclosed herein, is shown. As shown in FIGS. 6E-6G together, the movable armature 613 may include a plurality of armature vertical members 651 engaged and associated with an armature horizontal member 650. In an embodiment, each one of the armature vertical members 651 may be fixedly connected to the armature horizontal member 650.

The head gear assembly facial protector 612 may include the first set of horizontal members 616 and the first set of vertical members 618, whereby the first set of horizontal members 616 and the first set of vertical members are configured for crossing to form a general grid framework. In an embodiment, the at least one gap may be disposed within the grid framework.

Although not readily shown here, the movable armature 613 may include both a plurality of armature vertical members 651 and a plurality of armature horizontal members 650 connected therewith (see FIG. 10). In an embodiment, each one of the armature vertical members 651 may be fixedly connected to at least one of the plurality of armature horizontal members 650.

The engagement between the armature 613 and the facial protector 612 may form at least one gap with the gap size. Like other gaps (602, 605, FIG. 6A), the gap size of the at least one gap may be adjustable between a plurality of gap sizes. For example, the movable armature 613 may be moved from a first position (658, FIG. 6G) to a second position (659, FIG. 6G—dotted lines), whereby the gap size of the gap has changed accordingly.

Referring now to FIGS. 7A, 7B, 7C, and 7D, various perspective views of a movable armature operably connected with at least one adjustment mechanism according to embodiments disclosed herein, is shown. FIGS. 7A-7D together show a movable armature 713 may include a first end 755 and a second end 756, along with one or more adjustment mechanisms 757 operatively connected therewith. As shown, there may be a first adjustment mechanism 757 disposed on the first end 755. In an embodiment, a first position 758 of the at least one armature horizontal member 750 may be changed to a second position 759, such as via adjustment or operation of the first adjustment mechanism 757.

Figure 7A:
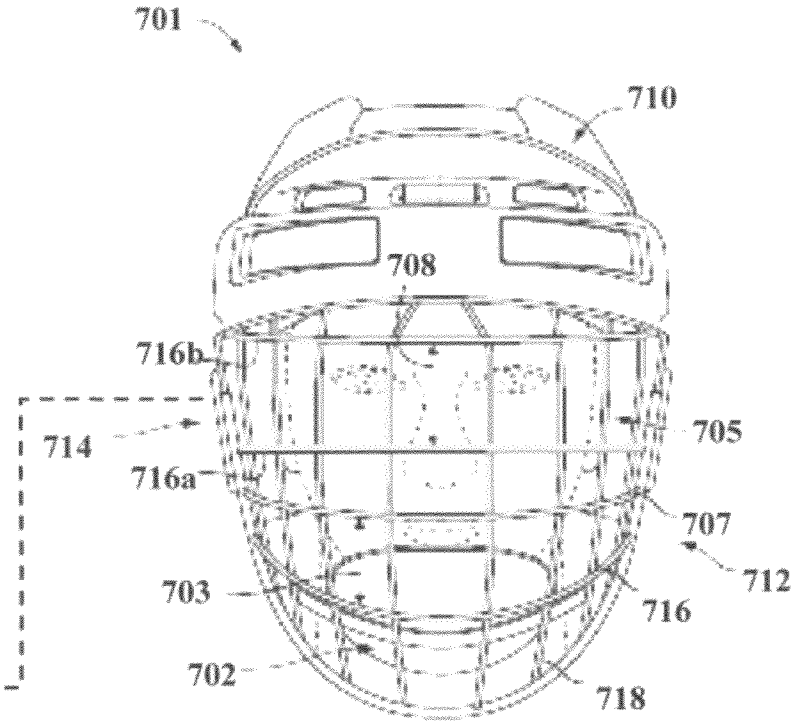
FIGS. 7A, 7B, 7C, and 7D show various perspective views of a movable armature operably connected with at least one adjustment mechanism, in accordance with embodiments of the present disclosure.
Figure 7B:
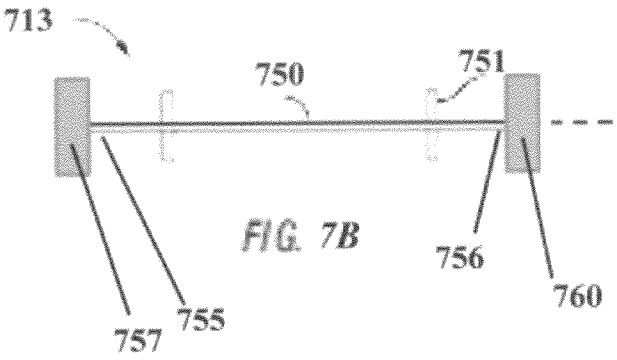
Figure 7C:
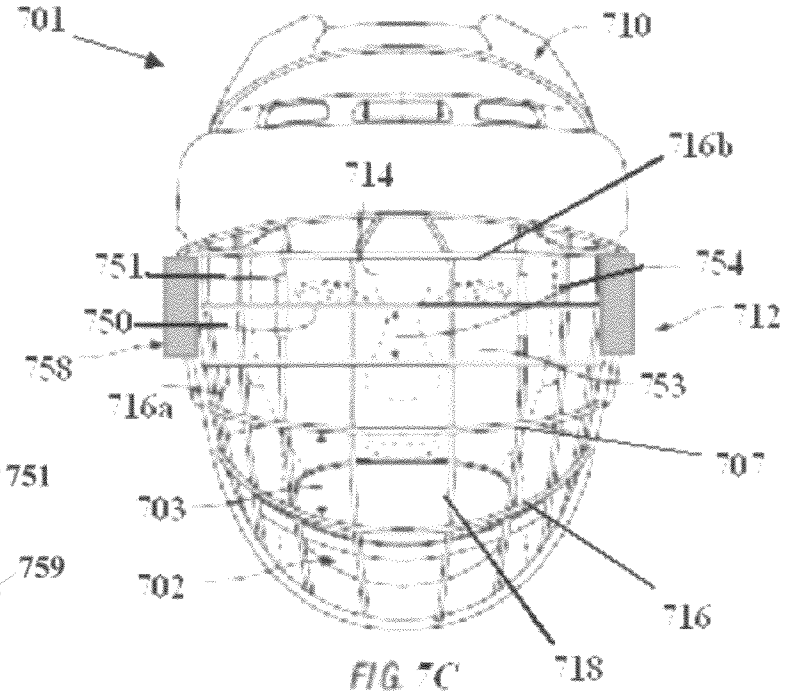
Figure 7D:
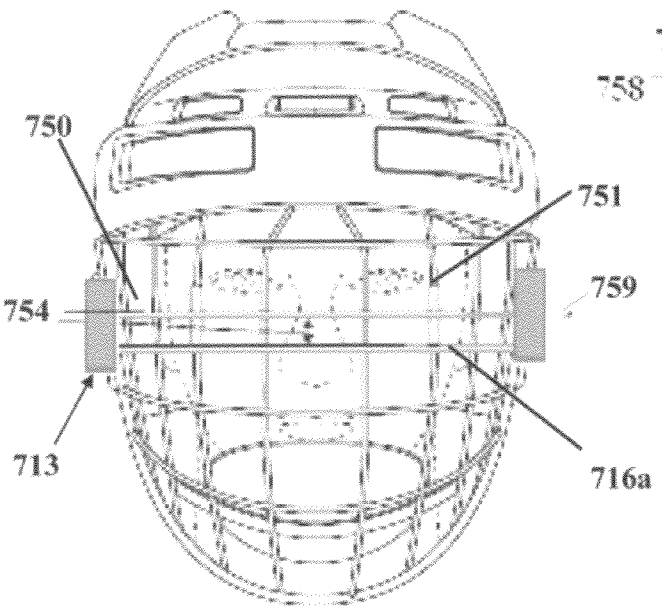

FIGS. 7C and 7D illustrate that upon engagement or connection of the movable armature 713 to the at least a portion 714 of the facial protector 712, operation or adjustment of the adjustment mechanism 757 may change the position of the armature horizontal member 750 from a first position 758 (FIG. 7C) to the second position 759 (FIG. 7D), while at the same time the facial protector 712 may remain stationary or unadjusted. In particular, and as a result of changing the position of the member 750, the gap size 754 may be adjusted by operating any adjustment mechanism, such as the first adjustment mechanism 757.

As shown by FIGS. 7A-7D together, the movable armature 713 may include additional adjustment mechanisms, such as a second mechanism 760 disposed on the second end 756. In an embodiment, the position of the at least one horizontal member 750, such as, the first position 758, may be changed by adjusting the second mechanism 760 simultaneously or separately from the first mechanism 757. In other words, the first adjustment mechanism 757 and the second adjustment mechanism 760 need not be dependent on one another, and may instead be separately operable. As such, the position of the horizontal member 750 may be changed by adjusting the first adjustment mechanism 757, the second adjustment mechanism 760, and combinations thereof. Any of the adjustment mechanisms 757, 760 described herein are not meant to be limited, and as such, may be any type of mechanism capable of moving a member of the armature 713.

Figure 8A:
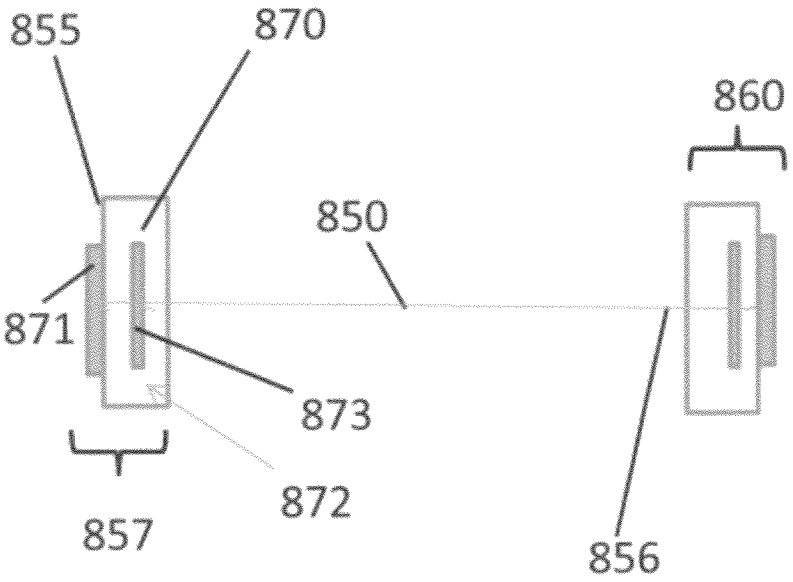
FIGS. 8A, 8B, 8C, 8D, and 8E show various views of an adjustment mechanism usable to move part of a movable armature, in accordance with embodiments of the present disclosure.

Referring briefly to FIGS. 8A, 8B, 8C, 8D, and 8E, various views of an adjustment mechanism usable to move part of a movable armature 813 according to embodiments disclosed herein, are shown. FIGS. 8A-8E together show, as but one example, the adjustment mechanism 857 may be a mechanism configured to translate motion of knob 871 into movement of the armature 813, including movement of the horizontal armature member 850. Although FIG. 8A shows a housing 870, the housing 870 is not shown in FIGS. 8B-8E.

While there is no limitation as to the need of the housing 870, examples illustrated in FIGS. 8B-8E may readily include the housing, as desired.

In an embodiment, the mechanism 857 may be configured to translate rotational motion into movement of the armature 813, including movement of the horizontal armature member 850. One or more adjustment mechanisms, such as adjustment mechanism 857, may be operatively disposed on and/or connected with the armature 813. In an embodiment, the adjustment mechanism 857 may include a housing (not shown here), whereby components of the adjustment mechanism 857 may be disposed or otherwise arranged within the housing.

Figure 8B:
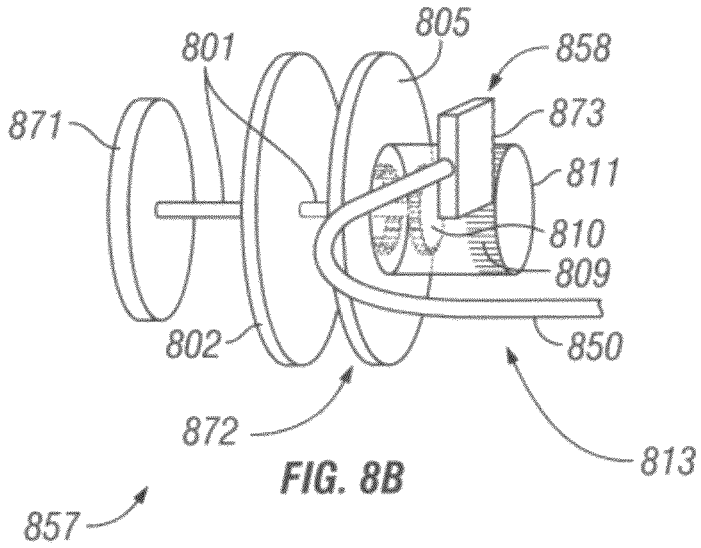
Figure 8C:
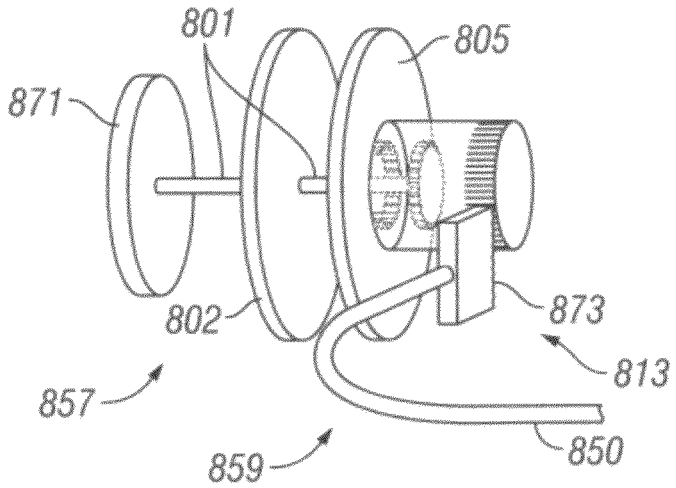
Figure 8D:
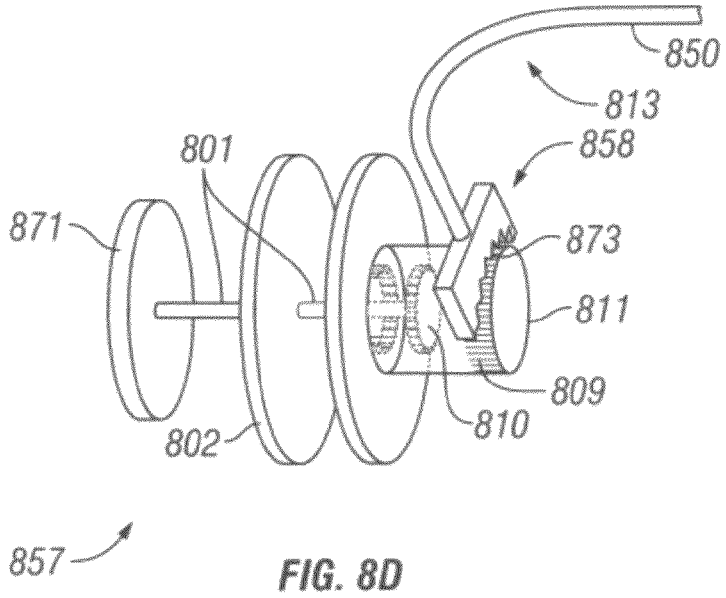
Figure 8E:
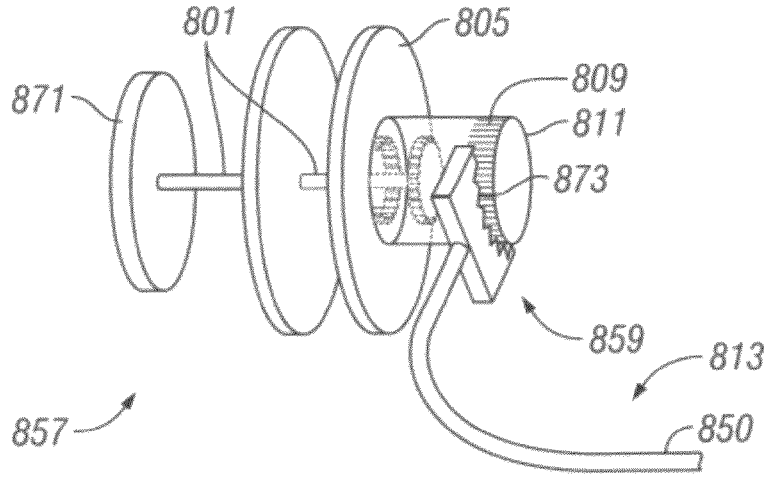

FIGS. 8B and 8C illustrate that to make an adjustment, a user (not shown) may rotate a wheel or knob 871 that in turn may cause gear train 872 to rotate and convey rotation to end piece 873 of the member 850. In an embodiment, the gear train 872 may include a number of interconnected gears, idler gears, etc. 802, 805.

Accordingly, the adjustment mechanism may include the gear train 872 disposed within the housing. The gear train 872 may include a gear, or set (e.g., system) of gear wheels, such as gears 802, 805. The gear train 872 may be configured to transfer rotational movement from the knob 871 to other parts of the mechanism or other parts connected therewith, such as the movable armature 813 and/or the associated member 850. For example, the movable armature 813 may include the end piece 873 coupled or formed therewith.

As would be understood by a person of ordinary skill, interlocked or meshed teeth in a set of gear wheels have circumferential surfaces that move at the same rate of linear motion (e.g., feet per second, etc.). When meshed gears are not the same size, the smaller gear will make a revolution before the larger gear makes. Thus, the smaller gear makes more revolutions in a given period of time, such that the smaller gear turns at a faster angular velocity compared to the larger gear. The relationship between angular velocity and number of teeth of a gear may be shown below:

$$(\text{Speed } A^{*}\text{Number of teeth } A)=(\text{Speed } B^{*}\text{Number of teeth } B) \quad \text{[Equation 1]}$$

Similarly, the torque ratio may be determined by considering the force that a tooth of one gear exerts on a tooth of another gear. For example, when teeth make contact between the two gears, the force exerted has a tangential component that causes turning. The torque is equal to the tangential component of the force times the radius. Accordingly, a larger gear will experience greater torque, while a smaller gear will experience less. The torque ratio is equal to the ratio of the diameters.

Thus, in accordance with embodiments disclosed herein, any of the gear trains or cluster(s) may be configured with any number and size gears to fulfill any requirements of gear ratio or torque ratio, as may be desired or necessary. Further, although shown as standard spur-type gears, the gears and gear interfaces are not meant to be so limited, as any gear mechanism could be used, such as helical gears, bevel gears, worm gears, or any other gear mechanism as would be understood by a person having ordinary skill in the art.

Although FIGS. 8B-8C show general up/down linear movement of the member 850 as a result of changing positions, the member 850 may just as easily have other types of movement, such as arced or radial. For example, FIGS. 8D-8E together show the moveable armature 813 may be in a first position 858, and upon movement of the member 850, the movable armature 813 may be in a second position 859. The member 850 may be moved by operating one or more adjustment mechanisms (e.g., 857, 860, etc.) connected therewith. As such, instead of linear movement, the movable armature 813 may incur a pivot moment. In an embodiment, the movement of the movable armature 813 may include a linear oriented movement (or vector), as well as a rotational or pivot oriented movement.

Figure 11A:
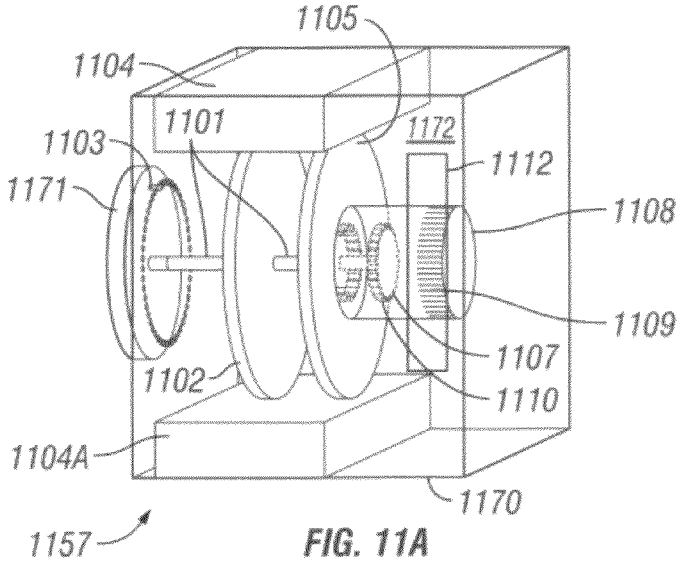
FIGS. 11A, 11B, and 11C show various close-up, partial internal views of an adjustment mechanism usable with a movable armature, in accordance with embodiments of the present disclosure.
Figure 11B:
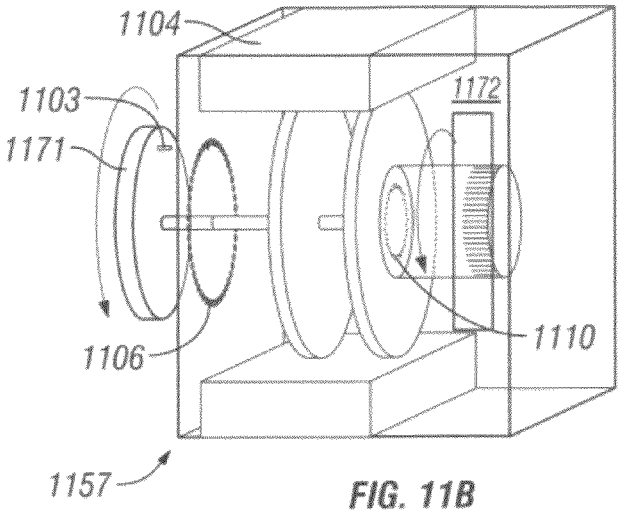
Figure 11C:
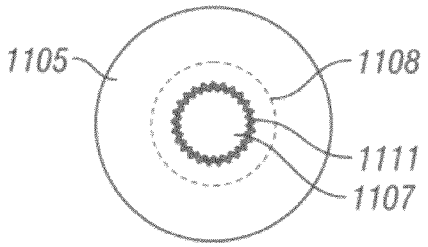

Referring now to FIGS. 11A, 11B, and 11C, various close-up, partial internal views of an adjustment mechanism usable with a movable armature according to embodiments of the present disclosure, are shown. FIGS. 11A-11C (not to scale) illustrate an example of the interconnectivity between various subcomponents of an adjustment mechanism 1157. The adjustment mechanism 1157 may be associated with a movable armature (not shown), whereby adjustment of the adjustment mechanism 1157 may change a position of, or otherwise cause to move, the movable armature (or parts thereof).

The adjustment mechanism 1157 may be a mechanism configured to translate motion of knob 1171 into movement of the armature, including movement of a horizontal armature member (not shown). One or more adjustment mechanisms, such as adjustment mechanism 1157, may be operatively disposed on and/or connected with the armature. The adjustment mechanism 1157 may include a housing 1170, whereby components of the adjustment mechanism 1157 may be disposed or otherwise arranged within the housing 1170.

The housing 1170 may be readily connected, such as fixedly or movingly, to the facial protector by any means, such as connector parts, rivets, welds, brackets, sliding members, etc. In some embodiments, the housing 1170 may be movably connected to the facial protector, while in other embodiments the housing 1170 may be fixedly connected to the facial protector.

As illustrated by FIGS. 11A and 11B together, to make an adjustment, a user (not shown) may rotate a wheel or knob 1171 that in turn may cause gear train 1172 to rotate and convey movement to an end piece of the horizontal member (not shown). As shown, the gear train 1172 may include a number of interconnected gears, idler gears, etc.

Accordingly, the adjustment mechanism 1157 may include the gear train 1172 disposed within the housing 1170, which may be configured to transfer movement, such as rotational movement, from the knob 1171 to other parts of the mechanism or other parts connected therewith, such as the movable armature and/or the associated member.

The adjustment mechanism 1157 may include a link 1101 connected between the knob 1171 and a first gear 1102 and/or a second gear 1105. The link 1101 may be fixedly connected to the knob 1171, and fixedly connected to one of the gears, whereby rotation of the knob causes a corresponding rotation of, for example, the first gear 1102.

Depending on operation, various components of the adjustment mechanism 1157 may be movable while others are stationary. For example, the knob 1171 may be configured with a locking or retainer pin 1103, which may be further configured for locking or otherwise retaining the knob 1171 in a stationary position, such that the adjustment mechanism 1157, and likewise the movable armature, may be prevented from any undesired or inadvertent movement.

The housing 1170 may be configured with any number of receptacles 1106 configured to receive and/or mate with the retainer pin 1103. In this regard, the knob 1171 may be movingly engageable with other components of the adjustment mechanism 1157. For example, the knob 1171 may be movingly engageable with the second gear 1105 by way of links 1101 and an engager 1107, such that movement of the knob may be translated to the second gear 1105

As shown, when the knob 1171 is pulled or otherwise moved in a particular direction, the retainer pin 1103 may be released from receptacles 1106, and at the same time the engager 1107 (disposed at the end of the link 1101) may move into an engaged position with the secondary gear 1105. Once engaged, as shown in FIG. 11B, any rotation or movement of the knob 1171 may be transferred to the second gear 1105 by way of the connection between the engager 1107 and the gear 1105. In an embodiment, the engager 1107 may be fitted with teeth 1110, which may be configured to mesh or otherwise mate with corresponding teeth 1111 disposed along a surface of the second gear 1105. FIG. 11C illustrates a side perspective view of the second gear 1105, including teeth 1111 disposed therewith, as well as the relative position of the connection between the second gear 1105 and a transmission piece 1108.

Thus, referring again to FIGS. 11A and 11B, the second gear 1105 may be operatively and/or fixedly connected with a transmission piece 1108. The transmission piece 1108 may be configured to mate with an end piece (see 873, FIG. 8A). Thus, to make an adjustment of the movable armature, a user (not shown) may rotate the wheel or knob 1171, which, via the gear train 1172, may convey rotation or movement to the end piece of the member (850, FIG. 8A). The interaction between the transmission piece 1108 and the end piece may be, for example, general up/down linear movement; however, there may just as easily have other types of movement, such as arced or radial. The movable armature may connect or otherwise interface with the adjustment mechanism 1157 by way of a window or slot 1112 disposed within the housing 1170.

The components of the adjustment mechanism 1157, such as the gear train, including the gears 1102 and/or 1105 may be supported within the housing 1170 by way of brace or support 1104. The brace 1104 may extend along an inner housing surface as may be necessary to support, for example, the gears 1102, 1105. In an embodiment, the gears 1102, 1105 may be freely movable against the brace 1104, such that there is limited friction as a result of the brace. In an embodiment, there may be a ball bearing configured within the brace 1104, such that any friction between the gears and the brace are minimized because there may be a freely rotating bearing surface. In other embodiments, there may be additional braces 1104A disposed within the housing 1170.

Figure 11D:
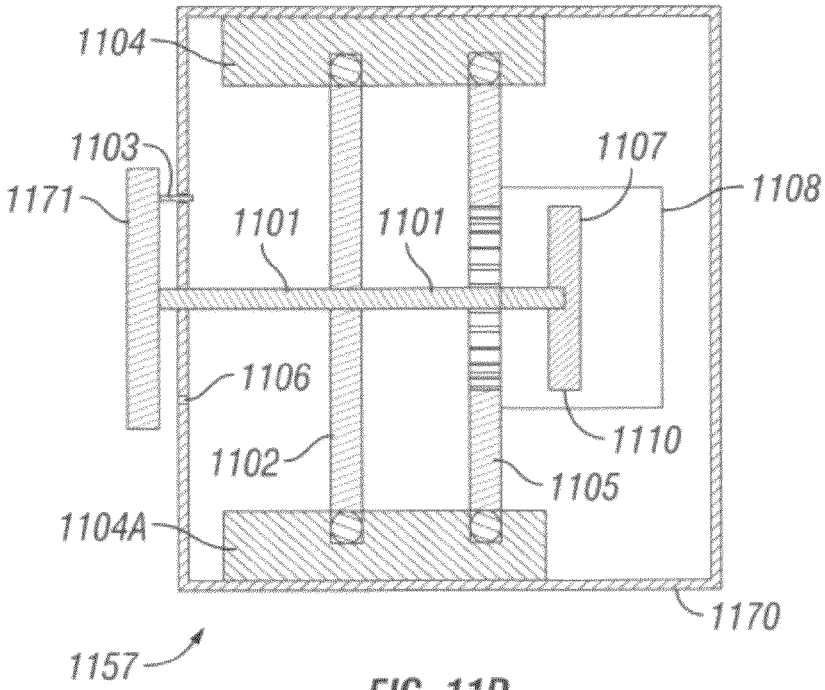
FIGS. 11D and 11E show cross-sectional views of the adjustment mechanism depicted in FIGS. 11A and 11B, respectively, in accordance with embodiments of the present disclosure.
Figure 11E:
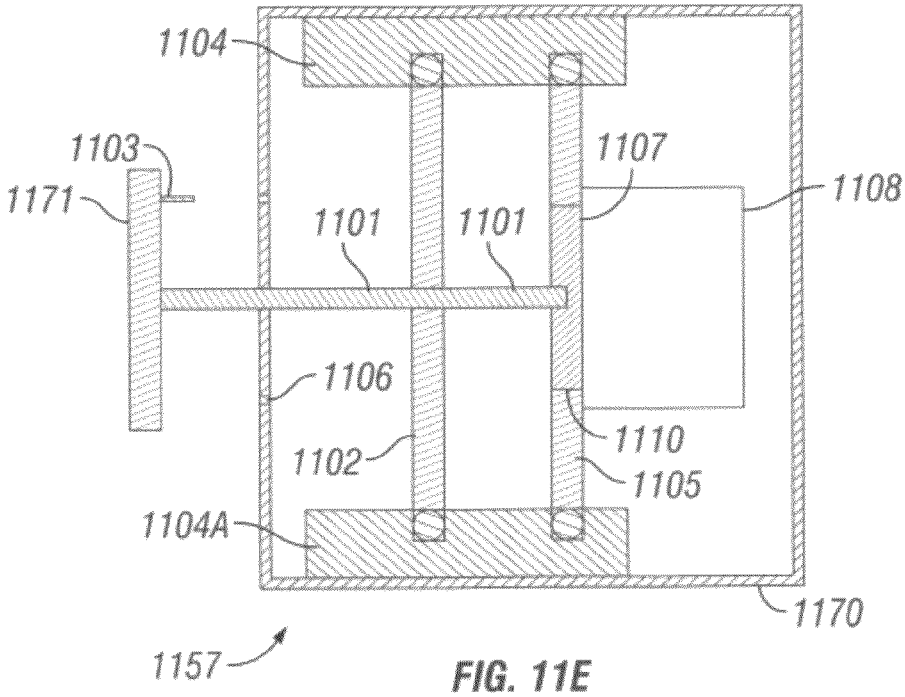

To help clarify the arrangement, configuration, and operation of the adjustment mechanism(s) shown in FIGS. 11A and 11B, cross-sectional views are provided by FIGS. 11D and 11E, respectively.

Returning now to FIGS. 7A-7D, a head gear assembly 701 configured with a facial protector 712 according to embodiments of the present disclosure, is shown. As illustrated by FIGS. 7A-7D together, the head gear assembly 701 may include an upper head portion 710 and a facial protector 712 configured for coupling to the upper head portion 710. The coupling of the facial protector 712 to the upper head portion 710 may be as previously described.

In accordance with embodiments disclosed herein, the facial protector may be manufactured or constructed with a movable armature 713 undetachably connected therewith. That is, although the movable armature 713 may be movingly engaged with the facial protector 712, the armature 713 may not be readily or freely removable from the facial protector without some sort of unpreferred damage or inadvertent removal.

As such, one or more horizontal armature members 750 may be slidingly movable along at least a portion 714 of the facial protector. For example, the armature may include a member 751 configured with an internal material that is adhesively or otherwise securely connected therewith. The internal material may have a bore formed therein, which may be configured for a corresponding vertical member 718 to pass therethrough, as shown in FIG. 7C. The member(s) 751 may sized accordingly so that the members 751 may traverse any distance along the vertical member 718. In an embodiment, the traversable length of member may be limited to the distance from horizontal member 716*a* and 716*b*.

Referring briefly to FIGS. 9A, 9B, 9C, and 9D, various views of a vertical member, including the vertical member movably engaged with an armature vertical member, according to embodiments disclosed herein, are shown. As previously mentioned, one or more horizontal armature members 950 may be slidingly movable along at least a portion (714, FIG. 7C) of the facial protector. As such, the armature 913 may include an armature member 951 configured with an internal member or material 997. In an embodiment, the internal material may be a resistive material 997A configured to adhesively or otherwise securely connect with the armature member 951.

Figure 9A:
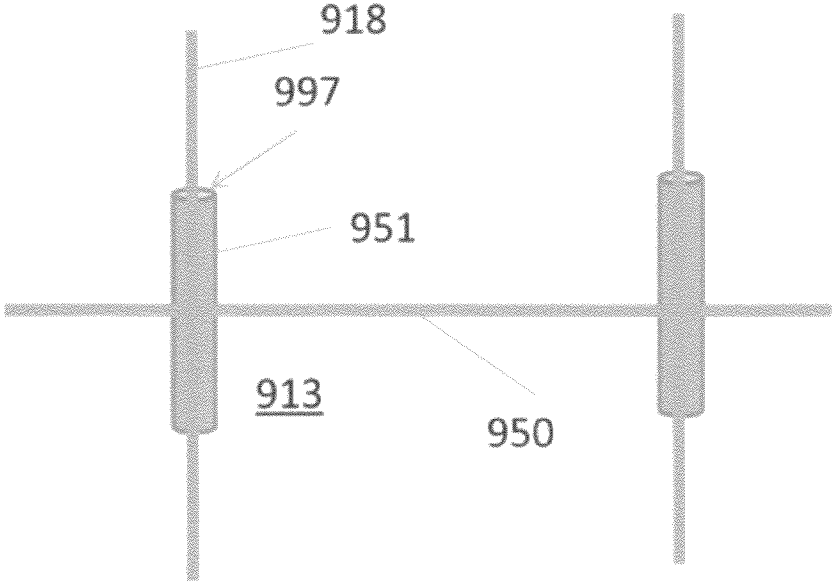
FIGS. 9A, 9B, 9C, and 9D show various views of a vertical member movably engaged with an armature vertical member, in accordance with embodiments of the present disclosure.
Figure 9B:
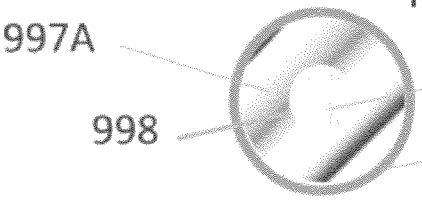

The internal material 997A may have a bore 998 formed therein, which may be configured for a corresponding vertical member 918 to pass therethrough, as shown in FIG. 9B. The member(s) 951 may sized accordingly so that the members 951 may traverse any distance along the vertical member 918.

Accordingly, the movable armature 913 may include the at least one vertical member 951 configured with a resistive material or element 997 therein. As such, upon connection or formation of the movable armature 913 with the head gear assembly facial protector 912, the resistive material or element may 997 sealingly yet slidably engages the one or more vertical member 951 to the facial protector 912. The bore 998 may be formed within the resistive material, whereby the member 951 may slidably engage with vertical member 918. In an embodiment, the resistive material may be a poly material. In a further embodiment, the poly material may adhesively attaches to the at least one vertical member 951, and at the same time slidably engage with the vertical member 918.

The connection between the movable armature and the facial protector may include respective vertical members slidingly engaged with each other, whereby sliding movement provides the plurality of gap sizes, and any subsequent adjustment of the gap sizes, as well as changing the position of horizontal armature member 950.

As previously described, embodiments disclosed herein may provide for a movable armature 913 configured for movable engagement to at least a portion of a facial protector (not shown here). In an embodiment, the engagement between the movable armature 913 and the facial protector may form at least one gap that has a corresponding gap size that may be adjustable from a first size to a plurality of other sizes. Although not shown here, the movable armature 913 may include a first adjustment mechanism operatively configured therewith. In an embodiment, the gap size may be adjusted by operating the adjustment mechanism.

The movable armature 913 may include at least one armature horizontal member 950 and at least one armature vertical member 951. Upon engagement between the movable armature 913 and the facial protector, there may be movable engagement between at least one of the plurality of generally vertical elements 918 and the at least one armature vertical member 951.

Figure 9C:
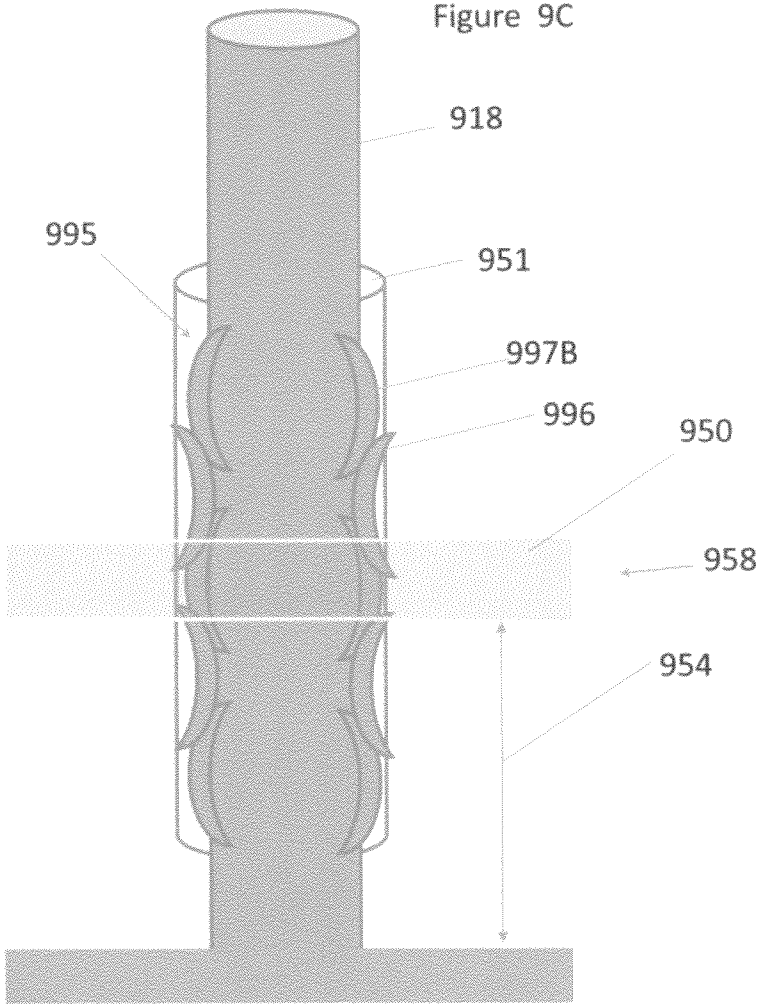
Figure 9D:
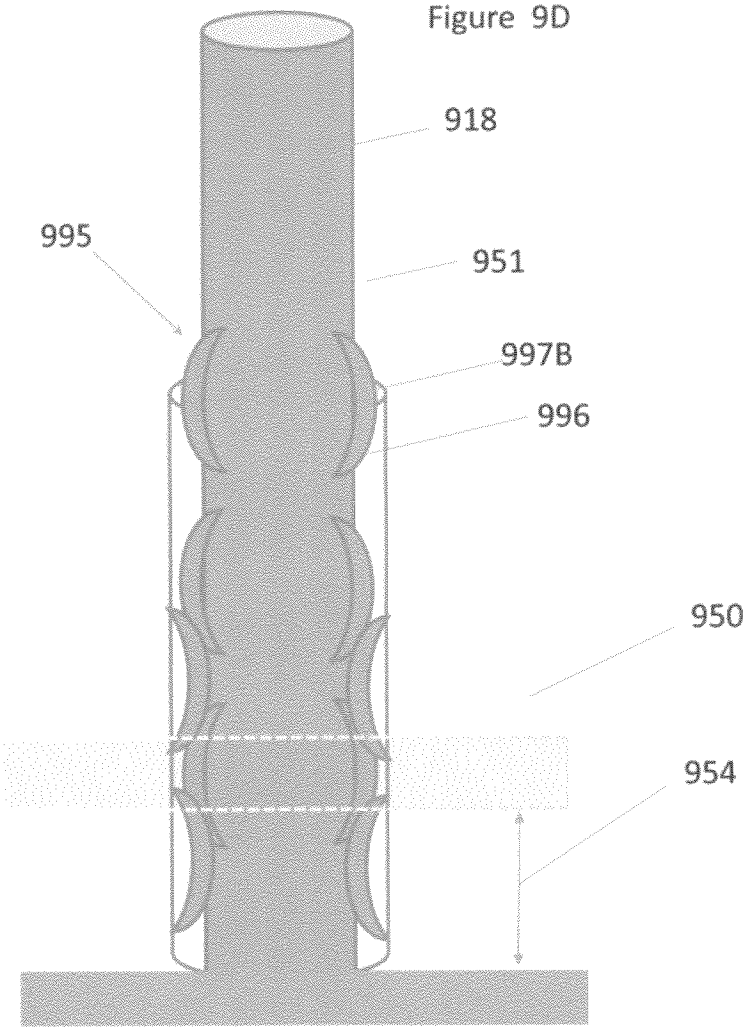

FIG. 9C illustrates the engagement between the movable armature 913 and the facial protector 912 may include an operable detent mechanism 995 that may be incrementally adjustable for changing the gap size (not shown here). As such, the vertical member 918 and/or the armature vertical member 951 may be fitted or otherwise configured with one or more resistive detent elements 997B.

The detent elements 997B may be, for example, rounded nubs or protrusions that, upon contact therebetween, provide some amount of frictional resistance to movement. However, upon a sufficient amount of force applied to the armature 913 or detent mechanism 995, the armature vertical member 951 may be moved with respect to the member 918. As such, the armature 913 may be moved from a first position 958 (FIG. 9C) to a second position 959 (FIG. 9D), thereby resulting in a change in a gap size 954. The operable detent mechanism 995 may be configured for a single direction of movement until a release is actuated.

Figures 10A, 10B, 10C:
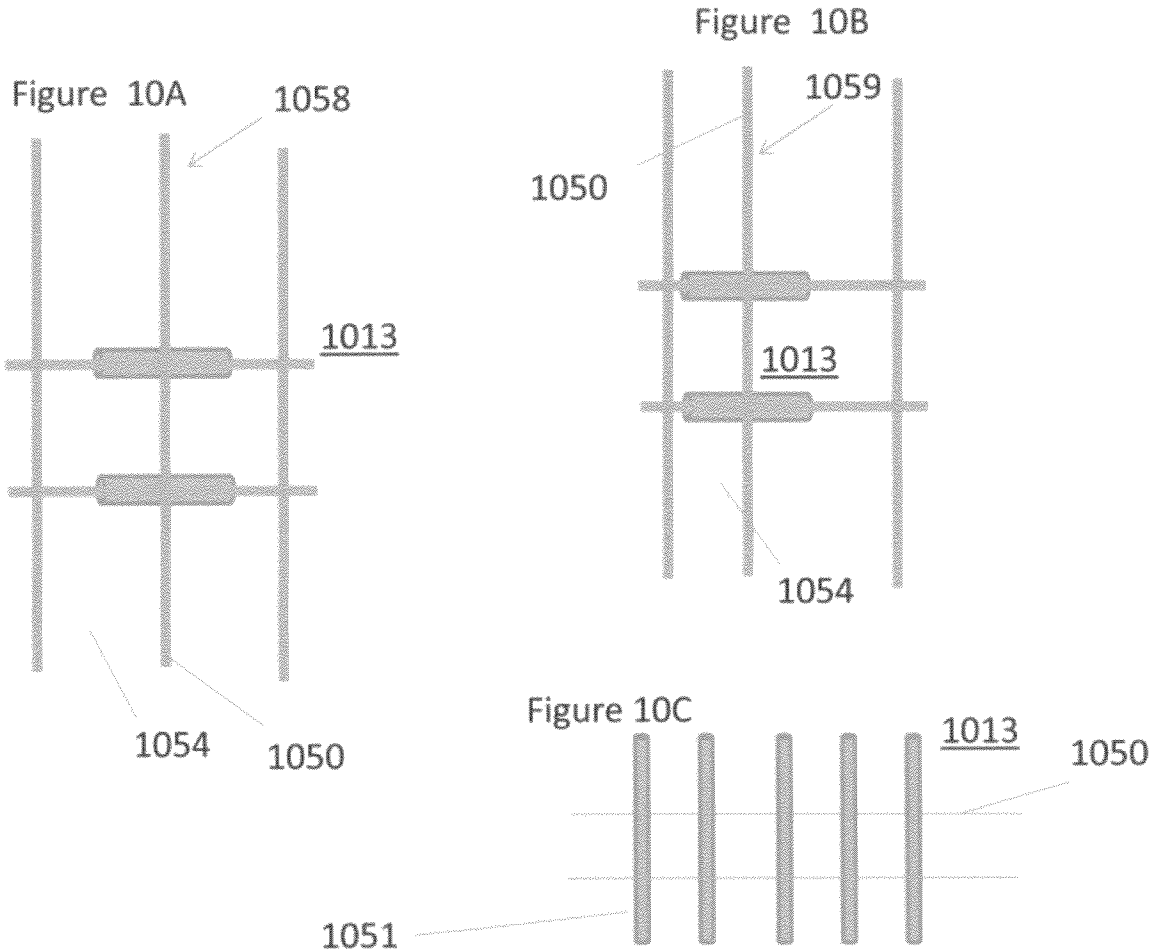
FIGS. 10A, 10B, and 10C show various views of a horizontal member engaged with an armature horizontal member, in accordance with embodiments of the present disclosure.

Referring briefly to FIGS. 10A, 10B, and 10C, various views of alternate configurations of a movable armature according to embodiments disclosed herein, are shown. FIGS. 10A and 10B together show the movable armature 1013 may be configured with a horizontal orientation. In this manner, and by way of illustration, the movable member 1050 may move left/right and/or right/left, instead of the previously described up/down. As such, the gap with the adjustable gap size may be adjusted with other orientations than just up/down.

Accordingly, the movable armature 1013 may include an armature vertical movable member 1050 connected with one or more horizontal armature members 1051. The movable armature 1013 may be moved from a first position 1058 to a second position 1059, whereby the gap size 1054 may change or adjust accordingly.

FIG. 10C illustrates the movable armature 1013 may include a plurality of armature members 1050 connected with other armature members 1051 with a different orientation. In an embodiment, the plurality of armature members 1050 may have a general perpendicular orientation with respect to the other armature members 1051.

Referring now to FIGS. 12A, 12B, 12D, and 12E, various partial front perspective views of an adjustable movable armature usable with a facial protector according to embodiments disclosed herein, are shown. In addition, FIG. 12C shows an angled perspective view of the adjustable movable armature depicted in FIGS. 12A and 12B according to embodiments disclosed herein.

Figures 12A, 12B, 12C:
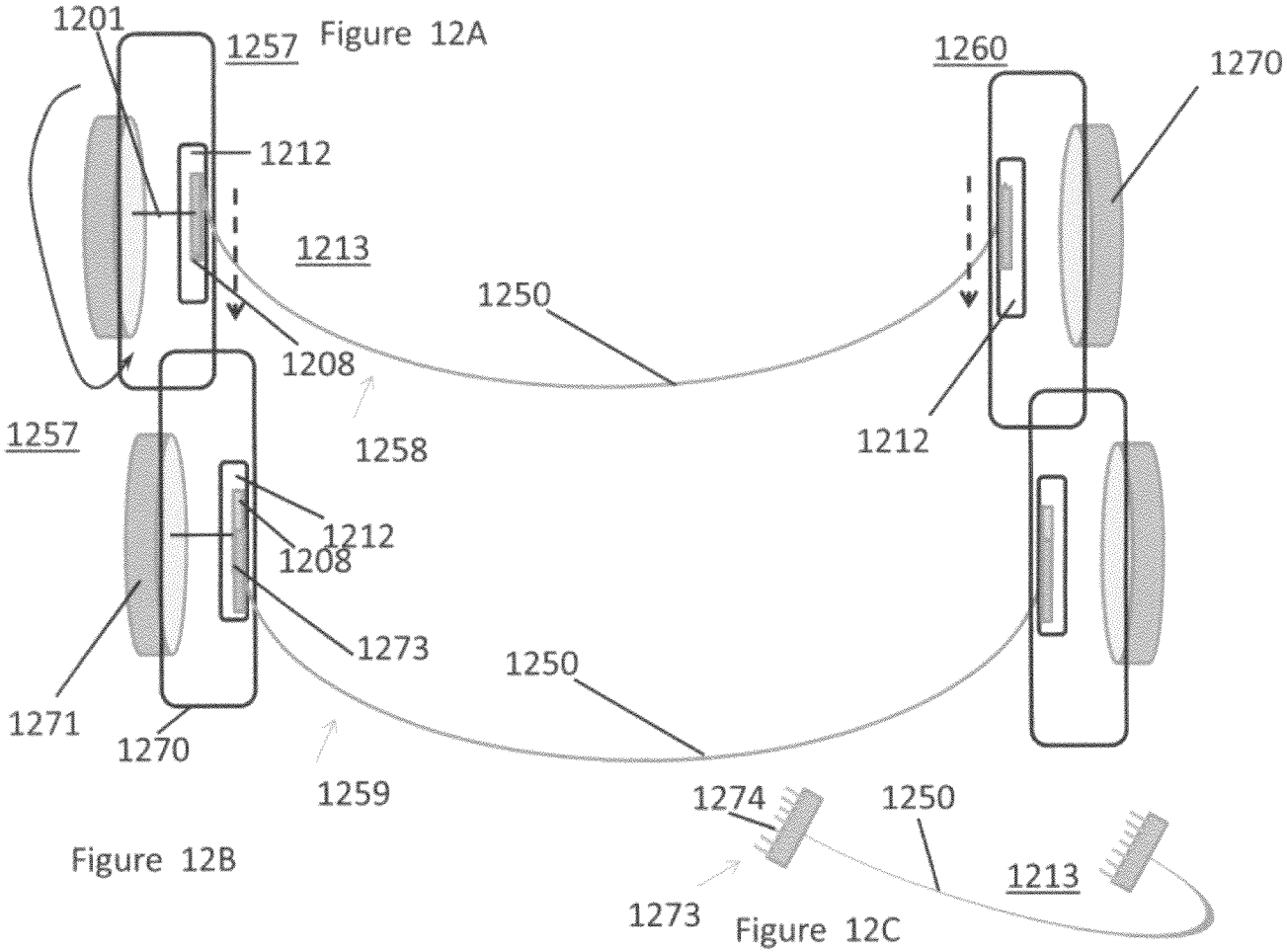
FIGS. 12A, 12B, 12D, and 12E show various partial front perspective views of an adjustable movable armature usable with a facial protector, in accordance with embodiments of the present disclosure.
FIG. 12C shows an angled perspective view of the adjustable movable armature depicted in FIGS. 12A and 12B, in accordance with embodiments of the present disclosure.

FIGS. 12A and 12B together show, as but one example, the adjustment mechanism 1257 may be a mechanism configured to translate motion of knob 1271 into movement of the armature 1213, including movement of the horizontal armature member 1250. In an embodiment, the mechanism 1257 may be configured to translate rotational motion into movement of the armature 1213, including movement of the horizontal armature member 1250. One or more adjustment mechanisms, such as adjustment mechanism 1257, may be operatively disposed on and/or connected with the armature 1213. In an embodiment, the adjustment mechanism 1257 may include a housing (not shown here), whereby components of the adjustment mechanism 1257 may be disposed or otherwise arranged within the housing.

To make an adjustment, a user (not shown) may rotate a wheel or knob 1271 that in turn may cause gear train 1272 to rotate and convey rotation to end piece 1273 of the member 1250. In an embodiment, the gear train 1272 may include a number of interconnected gears, idler gears, etc. 1202, 1205.

Accordingly, the adjustment mechanism may include the gear train 1272 disposed within the housing. The gear train 1272 may include a gear, or set (e.g., system) of gear wheels, such as gears 1202, 1205. The gear train 1272 may be configured to transfer rotational movement from the knob 1271 to other parts of the mechanism or other parts connected therewith, such as the movable armature 1213 and/or the associated member 1250. For example, the movable armature 1213 may include the end piece 1273 coupled or formed therewith.

Thus, in accordance with embodiments disclosed herein, any of the gear trains or cluster(s) may be configured with any number and size gears to fulfill any requirements of gear ratio or torque ratio, as may be desired or necessary. Further, although shown as standard spur-type gears, the gears and gear interfaces are not meant to be so limited, as any gear mechanism could be used, such as helical gears, bevel gears, worm gears, or any other gear mechanism as would be understood by a person having ordinary skill in the art.

Figures 12D, 12E:
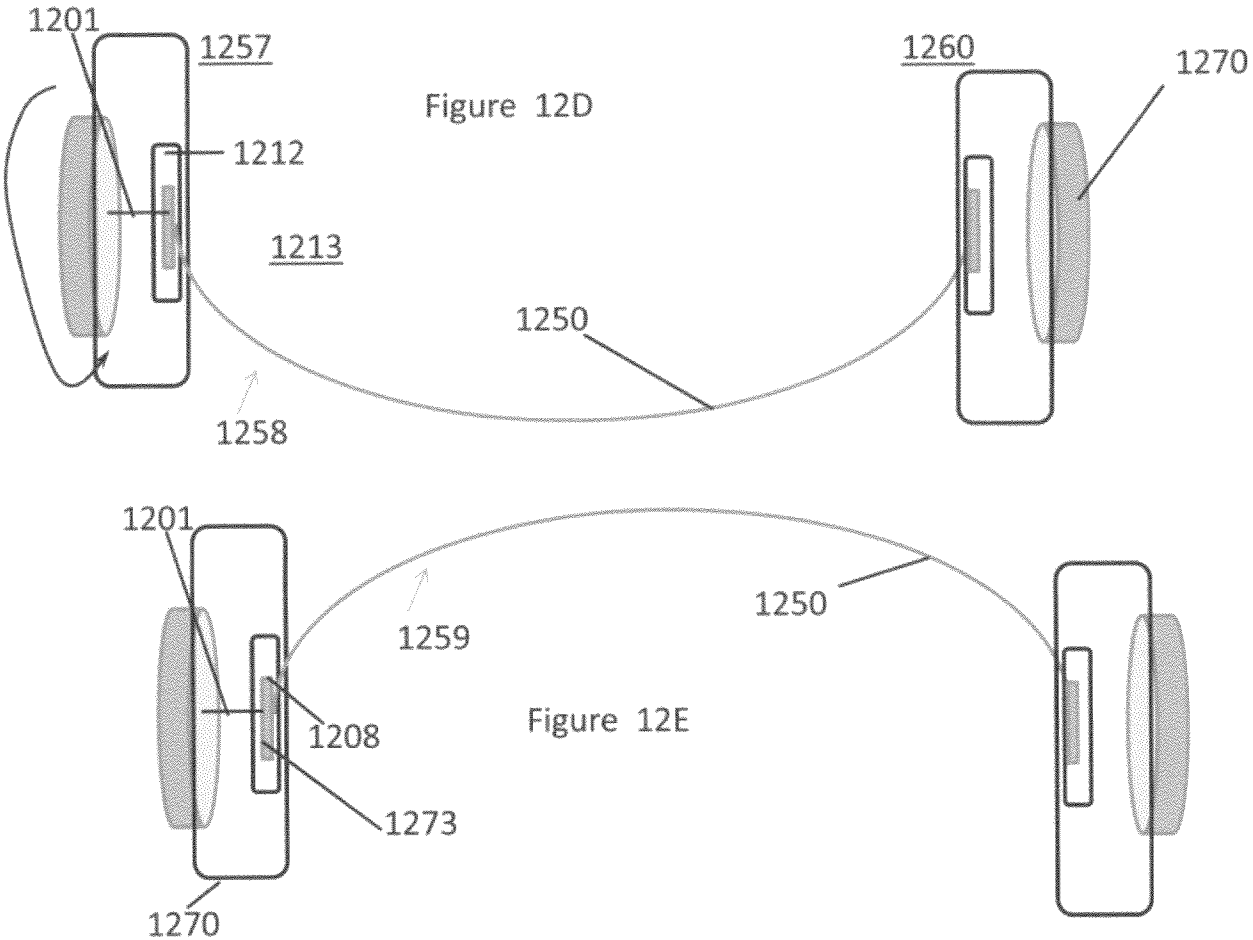

Although 12A and 12B show general up/down linear movement of the member 1250 as a result of changing positions, the member 1250 may just as easily have other types of movement, such as arced or radial. For example, FIG. 12D shows the moveable armature 1213 may be in a first position 1258, and upon movement of the member 1250, the movable armature 1213 may be in a second position 1259. The member 1250 may be moved by operating one or more adjustment mechanisms (e.g., 1257, 1260, etc.) connected therewith. As such, instead of linear movement, the movable armature 1213 incurs a pivot moment.

The adjustment mechanism 1257 may include a housing 1270, whereby components of the adjustment mechanism 1257 may be disposed or otherwise arranged within the housing 1270. The housing 1270 may be readily connected to the facial protector by any means, such as connector parts, rivets, welds, brackets, etc. In some embodiments, the housing 1270 may be movably connected to the facial protector, while in other embodiments the housing 1270 may be fixedly connected to the facial protector.

The adjustment mechanism 1257 may include a link 1201 connected between the knob 1271 and a first gear 1202 and/or a second gear 1205. The link 1201 may be fixedly connected to the knob 1271, and fixedly connected to one of the gears, whereby rotation of the knob causes a corresponding rotation of, for example, the first gear 1202.

Thus, to make an adjustment of the movable armature, a user (not shown) may rotate the wheel or knob 1271, which, via the gear train 1272, may convey rotation or movement to the end piece of the member (850, FIG. 8A). The interaction between the transmission piece 1208 and the end piece may be, for example, general up/down linear movement; however, there may just as easily have other types of movement, such as arced or radial. The movable armature may connect with the adjustment mechanism 1257 by way of a window or slot 1212 disposed within the housing 1270.

For example, FIGS. 12D and 12E together show the moveable armature 1213 may be in a first position 1258, and upon movement of the member 1250, the movable armature 1213 may be in a second position 1259. The member 1250 may be moved by operating one or more adjustment mechanisms (e.g., 1257, 1260, etc.) connected therewith. As such, instead of linear movement, the movable armature 1213 may incur a pivot moment. In an embodiment, the movement of the movable armature 1213 may include a linear oriented movement (or vector), as well as a rotational or pivot oriented movement.

Many variations on the embodiments disclosed herein will be obvious to those knowledgeable in the field, and such obvious variations are within the scope of the disclosure as described and claimed, whether or not expressly described. For example, as previously mentioned, it should be clear that the facial protector and any of the assemblies and adjusting devices could be adapted to be used with any form of protective headgear, such as catchers' masks for baseball and softball.

The grid sizes and horizontal/vertical member diameter could be any that meet a required opening size and required impact resistance. It is not necessary for embodiments disclosed herein for the horizontal/vertical members to be telescopingly (e.g., slidingly, etc.) engaged in the region of the eyes and nose. For example, the region of the mouth could have one or more horizontal elements configured with the previously described telescoping configuration.

The movable armature may be, for example, any type of movable member, horizontally oriented or otherwise, that may be movably attached to at least a portion of a facial protector. In simplest form, the movable armature may be a movable member, such as a horizontally oriented member, bar, element, etc.

Mount assemblies useable to connect components together may include a bolt and nut configuration, or optionally a "quick adjust" type fastening where the connection merely has a "locked" (or tight, secure, etc.) setting and an "unlocked" (or loose, unsecure, etc.) setting, as well as any other coupling device as would be known to a person of ordinary skill in the art. Thus, other clip or fastening devices know in the art may be used without deviating from the scope of the present disclosure. As also mentioned, a similar configuration could be used on the horizontal members, which would then be similarly adjusted to change the gap size.

Embodiments disclosed herein also pertain to a method for adjusting a dynamic vision gap. The method may include an initial step of selecting an appropriate head gear for a desired activity. For example, if a user was going to be participating in the sport of hockey, the user may select an appropriate head gear accordingly. The method may also consist of donning the head gear assembly, which may include a rigid shell, as well as a facial protector connectively attached to the rigid shell. The facial protector may have a gap comprising a gap size, wherein the gap size is adjustable from a first size to a plurality of other sizes. The method may also include a step for adjusting the gap size from the first size to one of a plurality of other sizes.

Other embodiments may pertain to a method for adjusting an ocular gap size. The method may include an initial step of selecting an appropriate head gear for a desired activity. For example, if a user was going to be participating in the sport of hockey, the user may select an appropriate head gear accordingly. The method may also consist of donning the head gear assembly, which may include a rigid shell, as well as a facial protector connectively attached to the rigid shell. The facial protector may have a gap comprising a gap size, wherein the gap size is adjustable from a first size to a plurality of other sizes. Further, the facial protector may be configured to establish a plane that may define a line of sight, such that the line-of-sight remains unchanged when the gap size is adjusted. The method may also include a step for adjusting the gap size from the first size to one of a plurality of other sizes.

Further embodiments disclosed herein may pertain to a method of manufacturing a head gear assembly comprising. The steps for doing so may include forming a rigid shell, and producing a facial protector configured to movingly attach to the rigid shell to fashion a protective head gear. The facial protector may have a gap with a gap size, wherein the gap size may be adjustable from a first size to a plurality of any other sizes.

The facial protector may also have a plurality of generally horizontal elements, and a plurality of generally vertical elements. Each generally vertical element may be configured in an upper portion and a lower portion of the facial protector. In an embodiment, the upper portion and the lower portion may be telescopingly engaged together so that as the gap size is adjusted the upper portion may move freely from the lower portion. Additionally, the vertical elements and horizontal elements may be configured for crossing one another to form a grid, such that the grid may have the ocular gap disposed therein.

Advantageously, embodiments disclosed herein provide a user with the ability to dynamically alter a gap within a facial protector, thereby enhancing the flexibility of a head gear assembly. The user may be provided with any multitude of gaps and/or gap sizes. The impairment of vision may be reduced, and subsequently the performance of the head gear assembly may be increased. Beneficially, safety performance may remain unchanged. Also advantageously, a user may have the ability to fractionally, incrementally, or otherwise, adjust a dynamic gap to provide improved range of vision and/or overall performance of a head gear assembly. Of significant benefit is the combination of improved vision, reduced impairment, improved ventilation, and maintained safety performance.

While the present disclosure has been described with respect to a limited number of embodiments, those skilled in the art, having benefit of the present disclosure will appreciate that other embodiments may be devised which do not depart from the scope of the disclosure described herein. Accordingly, the scope of the disclosure should be limited only by the claims appended hereto.

What is claimed is:

1. A head gear assembly comprising:

an upper head portion;

a facial protector connectively attached to the upper head portion further comprising:

a plurality of generally vertical elements; and a movable armature comprising at least one armature horizontal member and at least one armature vertical member, the movable armature configured for movable engagement to at least one of the plurality of generally vertical elements, wherein the engagement between the movable armature and the at least one of the plurality of generally vertical elements forms a gap further comprising a gap size, and wherein the gap size is adjustable from a first size to a plurality of other sizes.

2. The head gear assembly of claim 1, wherein the facial protector comprises at least one generally horizontal element.

3. The head gear assembly, wherein the movable armature comprises a plurality of armature horizontal members and a plurality of armature vertical members fixedly, wherein each one of the armature vertical members is fixedly connected to at least one of the plurality of armature horizontal members, and wherein the head gear assembly facial protector comprises a plurality of generally vertical elements and a plurality of generally horizontal elements configured to form a grid, and wherein the at least one gap is disposed within the grid.

4. The movable armature of claim 1 further comprising a plurality of armature horizontal members and a plurality of armature vertical members, wherein each one of the armature vertical members is fixedly connected to at least one of the plurality of armature horizontal members.

5. The movable armature of claim 1 further comprising:

a first end;

a second end; and a first adjustment mechanism disposed on the first end, wherein a position of the at least one armature horizontal member is changed by adjusting the first adjustment mechanism.

6. The movable armature of claim 5, wherein adjustment of the first adjustment mechanism changes the position of the at least one armature horizontal member while the head gear assembly facial protector remains substantially stationary.

7. The movable armature of claim 6, wherein the gap size is adjusted by operating the first adjustment mechanism.

8. The movable armature of claim 5, wherein the movable armature comprises:

a second mechanism disposed on the second end;

wherein the position of the at least one armature horizontal member is changed by adjusting the second mechanism.

9. The movable armature of claim 1, wherein the at least one armature vertical member comprises a movement resistive material.

10. A head gear assembly for protecting a user's head, the assembly comprising:

an upper head portion;

a facial protector connectively attached to the upper head portion further comprising:

a plurality of generally vertical elements;

a plurality of generally horizontal elements;

wherein the vertical elements and horizontal elements are configured to form a grid; and a movable armature comprising at least one armature horizontal member and at least one armature vertical member, the movable armature configured for movable engagement to at least one of the plurality of generally vertical elements, at least one of the plurality of generally horizontal elements, or at least one of both, wherein the engagement forms a gap further comprising a gap size, and wherein the gap size is adjustable from a first size to a plurality of other sizes.

11. The head gear assembly of claim 10, wherein the movable armature comprises a first adjustment mechanism operatively disposed thereon, and wherein the gap size is adjusted by operating the adjusting device.

12. The head gear assembly of claim 10, wherein engagement between the movable armature and the facial protector comprises an operable detent mechanism that is incrementally adjustable for changing the gap size.

13. A head gear assembly, the assembly comprising:

an upper head portion;

a facial protector connectively attached to the upper head portion further comprising:

a plurality of generally vertical elements;

a plurality of generally horizontal elements; and a movable armature comprising at least one armature horizontal member and at least one armature vertical member, the movable armature configured for movable engagement to at least one of the plurality of generally vertical elements, at least one of the plurality of generally horizontal elements, or at least one of both, wherein the engagement forms a gap further comprising an adjustable gap size.

14. The head gear assembly of claim 13, the head gear assembly further comprising a first adjustment mechanism operatively connected with the movable armature, wherein the adjustable gap size is adjustable from a first position to a second position by operating the adjusting device.

15. The head gear assembly of claim 13, wherein the movable armature comprises:

a first end;

a second end; and a first adjustment mechanism disposed on the first end, wherein a position of the at least one armature horizontal member is changed by adjusting the first adjustment mechanism.

16. The head gear assembly of claim 15, wherein the movable armature comprises:

a second mechanism disposed on the second end;

wherein the position of the at least one armature horizontal member is changed by adjusting the second mechanism.

* * * * *